US011015808B2

(12) United States Patent
Patel et al.

(10) Patent No.: US 11,015,808 B2
(45) Date of Patent: May 25, 2021

(54) AERODYNAMICALLY ENHANCED PREMIXER WITH PURGE SLOTS FOR REDUCED EMISSIONS

(71) Applicant: General Electric Company, Schenectady, NY (US)

(72) Inventors: Nayan Vinodbhai Patel, Liberty Township, OH (US); Duane Douglas Thomsen, Lebanon, OH (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 830 days.

(21) Appl. No.: 13/657,924

(22) Filed: Oct. 23, 2012

(65) Prior Publication Data

US 2013/0145765 A1 Jun. 13, 2013

Related U.S. Application Data

(60) Provisional application No. 61/569,904, filed on Dec. 13, 2011.

(51) Int. Cl.
*F23R 3/28* (2006.01)
*F23R 3/14* (2006.01)

(52) U.S. Cl.
CPC ..... *F23R 3/286* (2013.01); *F23R 3/14* (2013.01)

(58) Field of Classification Search
CPC ..... F23R 3/14; F23R 3/286
See application file for complete search history.

(56) References Cited

U.S. PATENT DOCUMENTS

| | | | |
|---|---|---|---|
| 3,966,353 | A | 6/1976 | Booher, Jr. et al. |
| 5,203,796 | A | 4/1993 | Washam et al. |
| 5,211,004 | A | 5/1993 | Black |
| 5,247,797 | A | 9/1993 | Fric et al. |
| 5,351,477 | A | 10/1994 | Joshi et al. |
| 5,377,483 | A | 1/1995 | Mowill |
| 5,477,671 | A | 12/1995 | Mowill |
| 5,481,866 | A | 1/1996 | Mowill |
| 5,572,862 | A | 11/1996 | Mowill |
| 5,613,357 | A | 3/1997 | Mowill |
| 5,628,182 | A | 5/1997 | Mowill |

(Continued)

FOREIGN PATENT DOCUMENTS

| | | |
|---|---|---|
| CN | 101377305 A | 3/2009 |
| EP | 0473371 | 3/1992 |

(Continued)

OTHER PUBLICATIONS

Search Report and Written Opinion from corresponding EP Application No. 12196367, dated Jul. 2, 2013.

(Continued)

*Primary Examiner* — Lorne E Meade
(74) *Attorney, Agent, or Firm* — Venable LLP; Edward A. Kmett; Michele V. Frank

(57) ABSTRACT

A System for Aerodynamic Premixer for Reduced Emissions comprising a premixer is generally cylindrical in form and defined by the relationship in physical space between a first ring, a second ring, and a plurality of radial vanes. The first and second rings are found to be generally equidistant, one from the other, at all points along their facing surfaces. Radial vanes connect the first ring to the second ring and thereby form the premixer.

6 Claims, 21 Drawing Sheets

(56) References Cited

U.S. PATENT DOCUMENTS

| | | | | |
|---|---|---|---|---|
| 5,638,674 | A | 6/1997 | Mowill | |
| 5,675,971 | A | 10/1997 | Angel et al. | |
| 5,680,766 | A | 10/1997 | Joshi et al. | |
| 5,713,205 | A | 2/1998 | Sciocchetti et al. | |
| 5,765,363 | A | 6/1998 | Mowill | |
| 5,778,676 | A | 7/1998 | Joshi et al. | |
| 5,822,992 | A | 10/1998 | Dean | |
| 5,924,276 | A | 7/1999 | Mowill | |
| 5,937,632 | A | 8/1999 | Döbbeling et al. | |
| 6,070,410 | A | 6/2000 | Dean | |
| 6,220,034 | B1 | 4/2001 | Mowill | |
| 6,311,473 | B1 | 11/2001 | Benjamin et al. | |
| 6,354,072 | B1 | 3/2002 | Hura | |
| 6,363,726 | B1 | 4/2002 | Durbin et al. | |
| 6,367,262 | B1 | 4/2002 | Mongia et al. | |
| 6,381,964 | B1 | 5/2002 | Pritchard, Jr. et al. | |
| 6,389,815 | B1 * | 5/2002 | Hura | F23R 3/346 60/746 |
| 6,418,726 | B1 | 7/2002 | Foust et al. | |
| 6,438,961 | B2 | 8/2002 | Tuthill et al. | |
| 6,442,939 | B1 | 9/2002 | Stuttaford et al. | |
| 6,453,660 | B1 | 9/2002 | Johnson et al. | |
| 6,484,489 | B1 | 11/2002 | Foust et al. | |
| 6,536,216 | B2 | 3/2003 | Halila et al. | |
| 6,539,721 | B2 | 4/2003 | Oikawa et al. | |
| 6,571,559 | B1 | 6/2003 | Fortuna et al. | |
| 6,604,286 | B2 | 8/2003 | Halila et al. | |
| 6,898,938 | B2 * | 5/2005 | Mancini | F23D 11/107 60/740 |
| 6,915,636 | B2 | 7/2005 | Stuttaford et al. | |
| 6,925,809 | B2 | 8/2005 | Mowill | |
| 6,968,692 | B2 | 11/2005 | Chin et al. | |
| 6,976,363 | B2 * | 12/2005 | McMasters | F23R 3/002 60/748 |
| 7,010,923 | B2 | 3/2006 | Mancini et al. | |
| 7,117,676 | B2 | 10/2006 | Farhangi et al. | |
| 7,162,874 | B2 | 1/2007 | Mowill | |
| 7,434,401 | B2 | 10/2008 | Hayashi | |
| 7,464,553 | B2 | 12/2008 | Hsieh et al. | |
| 7,581,396 | B2 * | 9/2009 | Hsieh | F23R 3/14 60/748 |
| 7,762,073 | B2 | 7/2010 | Li et al. | |
| 7,926,281 | B2 * | 4/2011 | Commaret | F23D 11/107 60/737 |
| 9,303,876 | B2 * | 4/2016 | Hernandez | F23R 3/14 |
| 2001/0052229 | A1 | 12/2001 | Tuthill et al. | |
| 2002/0069645 | A1 | 6/2002 | Mowill | |
| 2002/0078690 | A1 | 6/2002 | Stuttaford et al. | |
| 2002/0178727 | A1 | 12/2002 | Halila et al. | |
| 2003/0010030 | A1 | 1/2003 | Oikawa et al. | |
| 2003/0046935 | A1 | 3/2003 | Halila et al. | |
| 2004/0003596 | A1 | 1/2004 | Chin et al. | |
| 2004/0006993 | A1 | 1/2004 | Stuttaford et al. | |
| 2004/0187499 | A1 | 9/2004 | Farhangi et al. | |
| 2005/0039456 | A1 | 2/2005 | Hayashi | |
| 2006/0021354 | A1 | 2/2006 | Mowill | |
| 2007/0028618 | A1 * | 2/2007 | Hsiao | F23R 3/14 60/737 |
| 2007/0119183 | A1 | 5/2007 | Evulet | |
| 2008/0041059 | A1 | 2/2008 | Teets | |
| 2008/0168773 | A1 * | 7/2008 | Sandelis | F23R 3/14 60/748 |
| 2009/0044537 | A1 | 2/2009 | Boardman et al. | |
| 2009/0056336 | A1 | 3/2009 | Chila et al. | |
| 2009/0139237 | A1 | 6/2009 | Sullivan et al. | |
| 2009/0249789 | A1 | 10/2009 | Zuo et al. | |
| 2009/0293444 | A1 | 12/2009 | Stuttaford | |
| 2009/0293482 | A1 | 12/2009 | Davis, Jr. et al. | |
| 2010/0011770 | A1 | 1/2010 | Chila et al. | |
| 2010/0064691 | A1 | 3/2010 | Laster et al. | |
| 2010/0205971 | A1 * | 8/2010 | Williams | F23D 11/107 60/748 |
| 2010/0247292 | A1 | 9/2010 | Davis, Jr. et al. | |
| 2010/0263382 | A1 | 10/2010 | Mancini et al. | |
| 2011/0289929 | A1 | 12/2011 | Khan et al. | |
| 2012/0304650 | A1 * | 12/2012 | Hernandez | F23R 3/14 60/737 |

FOREIGN PATENT DOCUMENTS

| | | | | |
|---|---|---|---|---|
| EP | 0549191 | | 6/1993 | |
| EP | 0572202 | | 12/1993 | |
| EP | 0635681 | | 6/1994 | |
| EP | 0691512 | | 1/1996 | |
| EP | 0731316 | | 9/1996 | |
| EP | 0892219 | | 7/1997 | |
| EP | 0823591 | | 2/1998 | |
| EP | 0936406 | | 2/1999 | |
| EP | 0926325 | | 8/1999 | |
| EP | 1036988 | | 9/2000 | |
| EP | 1319896 | | 12/2002 | |
| EP | 1510759 | A1 | 3/2005 | |
| EP | 1672282 | | 6/2006 | |
| EP | 2018917 | | 1/2009 | |
| EP | 2017534 | | 2/2009 | |
| EP | 2065643 | | 6/2009 | |
| EP | 2078742 | | 7/2009 | |
| EP | 2090769 | | 8/2009 | |
| EP | 2128504 | | 12/2009 | |
| JP | 51108110 | A | 9/1976 | |
| JP | 2010236545 | A | 10/2010 | |
| JP | 2011247263 | A | 12/2011 | |
| WO | 1999014464 | | 3/1999 | |
| WO | 2001040713 | | 6/2001 | |
| WO | 2002052134 | | 7/2002 | |
| WO | 2003006886 | | 1/2003 | |
| WO | 2003091557 | | 11/2003 | |
| WO | 2004085815 | | 10/2004 | |
| WO | WO-2011104304 | A2 * | 9/2011 | F23R 3/14 |

OTHER PUBLICATIONS

Unofficial English Translation of Chinese Office Action issued in connection with corresponding CN Application No. 201210536971.9 dated Jul. 31, 2015.

Unofficial English Translation of Japanese Office Action issued in connection with corresponding JP Application No. 012269892 dated Sep. 13, 2016.

* cited by examiner

AERODYNAMICALLY ENHANCED PREMIXER WITH PURGE SLOTS FOR REDUCED EMISSIONS

CROSS-REFERENCE TO RELATED APPLICATIONS

The current application claims priority to U.S. Provisional Application, Ser. No. 61/569,904, filed Dec. 13, 2011, the entire disclosure of which is incorporated herein by reference.

BRIEF DESCRIPTION OF THE DRAWINGS

The system for aerodynamically enhanced premixer for reduced emissions may be best understood by reference to the following description taken in conjunction with the accompanying drawing figures in which:

FIGS. 8-9, 10-11, 12-13*a*, 14-15, 16-17, 18-19, 20-21, 22-23, 24-25, 28-29, and 30-31 provide a pair of views, the first view of each pair shown in perspective and the second view of each pair in sectional, each pair of views so chosen to illustrate selected details of alternative embodiments of an aerodynamically enhanced premixer.

BACKGROUND AND PROBLEM SOLVED

Figure 1:
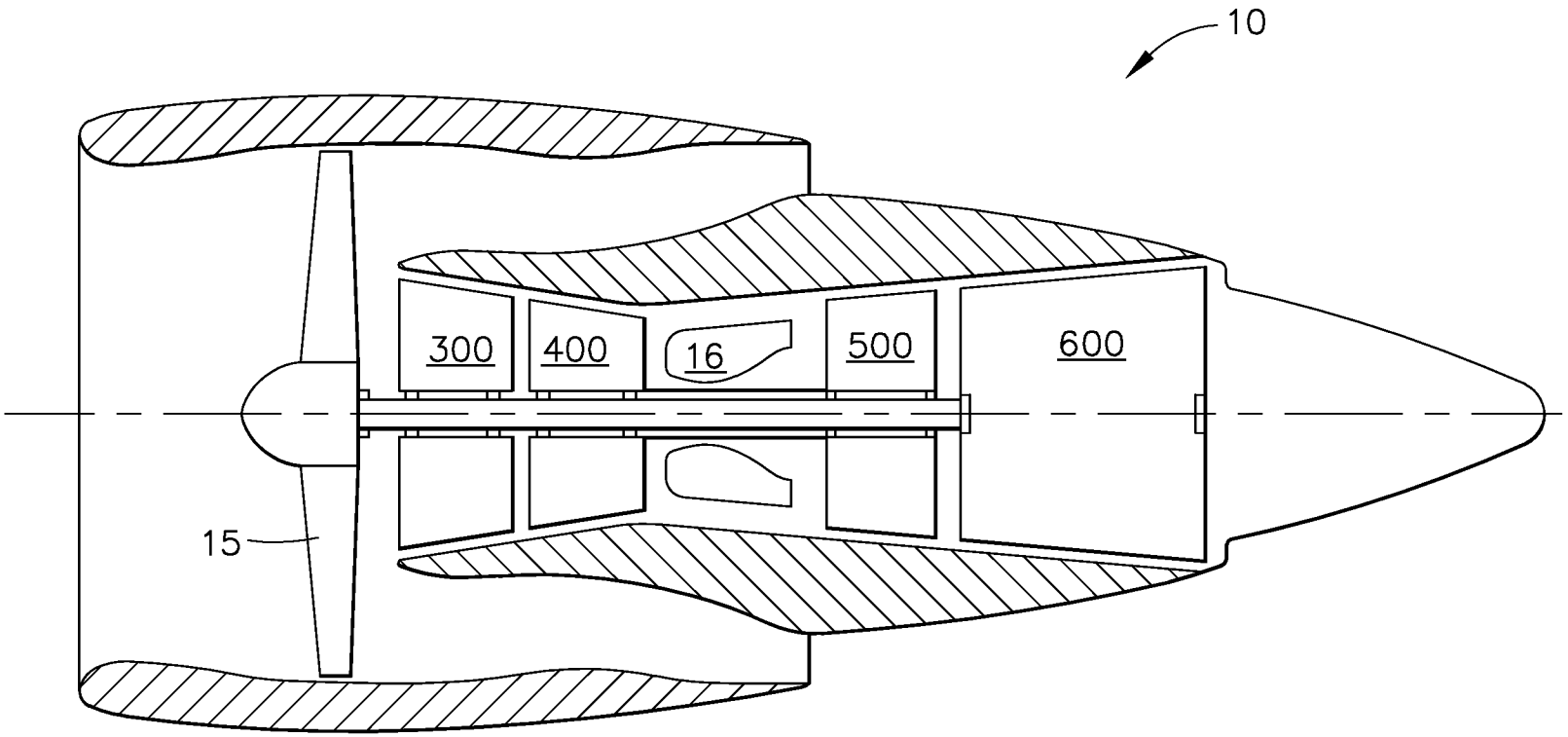
FIG. 1 is a schematic illustration of a gas turbine engine including a combustor.

Embodiments and alternatives are provided of a premixer that improves fuel efficiency while reducing exhaust gas emissions. Embodiments include those wherein a boundary layer profile over the fuel nozzle (center-body) is controlled to minimize emissions. In the past, it has been difficult to increase flow velocity at the flow boundary layer while also sizing components properly to achieve optimum vane shape in a premixer as well as positioning swirlers within the combustor system closer together. As such, embodiments and alternatives are provided that achieve accurate control of boundary layer profile over the fuel nozzle (center-body) by utilizing mixer-to-mixer proximity reduction, premixer vane tilt to include the use of compound angles, reduced nozzle/mixer tilt sensitivity, and mixer foot contouring. Additional boundary layer control is realized using purge slots, placed on either or both of the premixer foot or the nozzle outer diameter, and a splitter when employed with a twin radial mixer.

Multiple Embodiments and Alternatives

By way of general reference, aircraft gas turbine engine staged combustion systems have been developed to limit the production of undesirable combustion product components such as oxides of nitrogen (NOx), unburned hydrocarbons (HC), and carbon monoxide (CO) particularly in the vicinity of airports, where they contribute to urban photochemical smog problems. Gas turbine engines also are designed to be fuel efficient and to have a low cost of operation. Other factors that influence combustor design are the desires of users of gas turbine engines for efficient, low cost operation, which translates into a need for reduced fuel consumption while at the same time maintaining or even increasing engine output. As a consequence, important design criteria for aircraft gas turbine engine combustion systems include provisions for high combustion temperatures, in order to provide high thermal efficiency under a variety of engine operating conditions. Additionally, it is important to minimize undesirable combustion conditions that contribute to the emission of particulates, and to the emission of undesirable gases, and to the emission of combustion products that are precursors to the formation of photochemical smog.

One mixer design that has been utilized is known as a twin annular premixing swirler (TAPS), which is disclosed in the following U.S. Pat. Nos. 6,354,072; 6,363,726; 6,367,262; 6,381,964; 6,389,815; 6,418,726; 6,453,660; 6,484,489; and, 6,865,889. It will be understood that the TAPS mixer assembly includes a pilot mixer which is supplied with fuel during the entire engine operating cycle and a main mixer which is supplied with fuel only during increased power conditions of the engine operating cycle. While improvements in the main mixer of the assembly during high power conditions (i.e., take-off and climb) are disclosed in patent applications having Ser. Nos. 11/188,596, 11/188,598, and 11/188,470, modification of the pilot mixer is desired to improve operability across other portions of the engine's operating envelope (i.e., idle, approach and cruise) while maintaining combustion efficiency. To this end and in order to provide increased functionality and flexibility, the pilot mixer in a TAPS type mixer assembly has been developed and is disclosed in U.S. Pat. No. 7,762,073, entitled "Pilot Mixer For Mixer Assembly Of A Gas Turbine Engine Combustor Having A Primary Fuel Injector And A Plurality Of Secondary Fuel Injection Ports" which issued Jul. 27, 2010. This patent is owned by the assignee of the present application and hereby incorporated by reference.

U.S. patent application Ser. No. 12/424,612 (PUBLICATION NUMBER 20100263382), filed Apr. 16, 2009, entitled "DUAL ORIFICE PILOT FUEL INJECTOR" discloses a fuel nozzle having first second pilot fuel nozzles designed to improve sub-idle efficiency, reduced circumferential exhaust gas temperature (EGT) variation while maintaining a low susceptibility to coking of the fuel injectors. This patent application is owned by the assignee of the present application and hereby incorporated by reference.

FIG. 1 is provided as an orientation and to illustrate selected components of a gas turbine engine 10 which includes a bypass fan 15, a low pressure compressor 300, a high pressure compressor 400, a combustor 16, a high pressure turbine 500 and a low pressure turbine 600.

Figure 2:
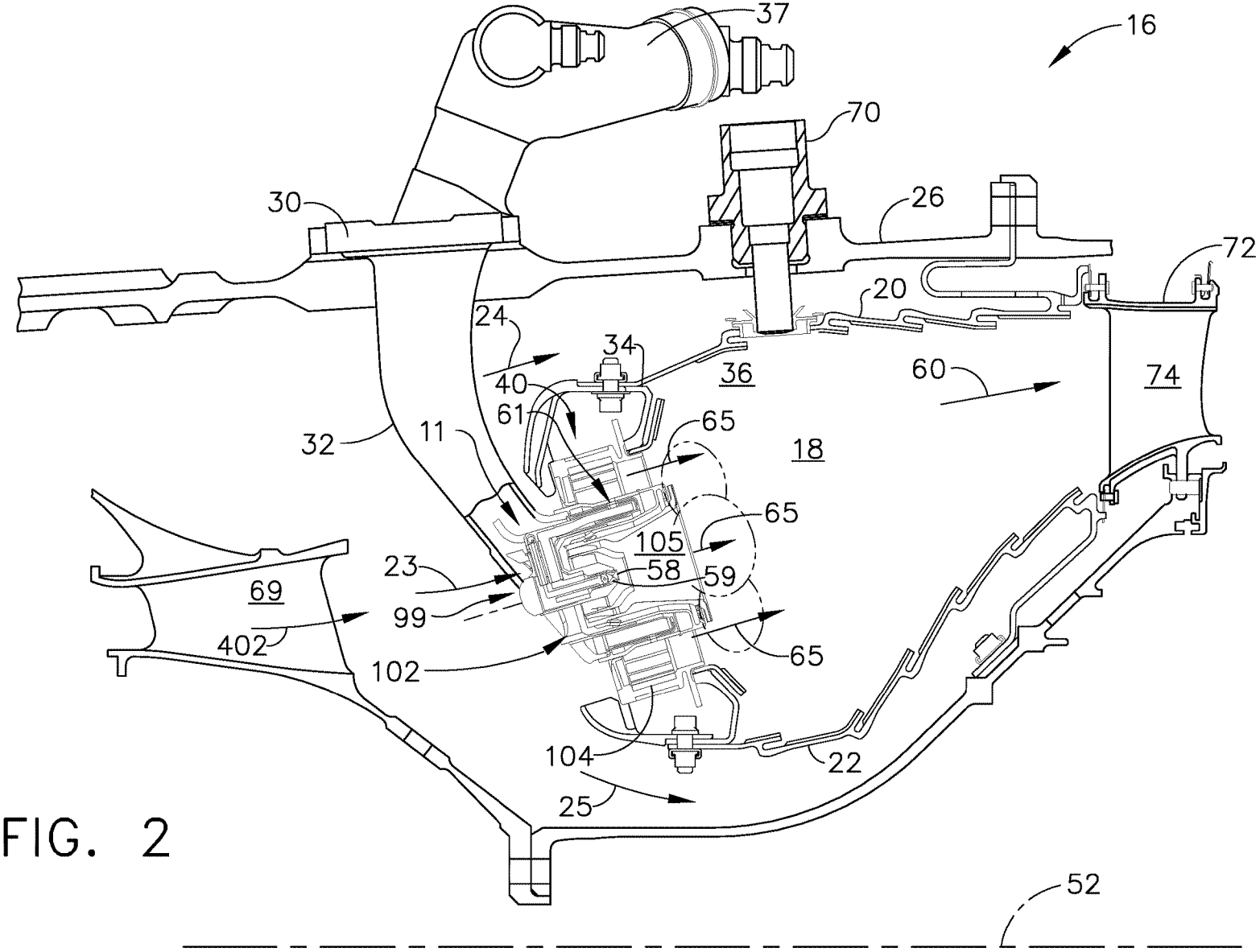
FIG. 2 is a cross-sectional view illustration of a gas turbine engine combustor with an exemplary embodiment of an aerodynamically enhanced premixer.

With reference to FIG. 2, illustrated is an exemplary embodiment of a combustor 16 including a combustion zone 18 defined between and by annular radially outer and inner liners 20, 22, respectively circumscribed about an engine centerline 52. The outer and inner liners 20, 22 are located radially inwardly of an annular combustor casing 26 which extends circumferentially around outer and inner liners 20, 22. The combustor 16 also includes an annular dome 34 mounted upstream of the combustion zone 18 and attached to the outer and inner liners 20, 22. The dome 34 defines an upstream end 36 of the combustion zone 18 and a plurality of mixer assemblies 40 (only one is illustrated) are spaced circumferentially around the dome 34. Each mixer assembly 40 includes a premixer 104 mounted in the dome 34 and a pilot mixer 102.

The combustor 16 receives an annular stream of pressurized compressor discharge air 402 from a high pressure compressor discharge outlet 69 at what is referred to as CDP air (compressor discharge pressure air). A first portion 23 of the compressor discharge air 402 flows into the mixer assembly 40, where fuel is also injected to mix with the air and form a fuel-air mixture 65 that is provided to the combustion zone 18 for combustion. Ignition of the fuel-air mixture 65 is accomplished by a suitable igniter 70, and the resulting combustion gases 60 flow in an axial direction toward and into an annular, first stage turbine nozzle 72. The first stage turbine nozzle 72 is defined by an annular flow channel that includes a plurality of radially extending, circularly-spaced nozzle vanes 74 that turn the gases so that they flow angularly and impinge upon the first stage turbine blades (not shown) of a first turbine (not shown).

The arrows in FIG. 2 illustrate the directions in which compressor discharge air flows within combustor 16. A second portion 24 of the compressor discharge air 402 flows around the outer liner 20 and a third portion 25 of the compressor discharge air 402 flows around the inner liner 22. A fuel injector 11, further illustrated in FIG. 2, includes a nozzle mount or flange 30 adapted to be fixed and sealed to the combustor casing 26. A hollow stem 32 of the fuel injector 11 is integral with or fixed to the flange 30 (such as by brazing or welding) and includes a fuel nozzle assembly 12. The hollow stem 32 supports the fuel nozzle assembly 12 and the pilot mixer 102. A valve housing 37 at the top of the stem 32 contains valves illustrated and discussed in more detail in United States Patent Application No. 20100263382, referenced above.

Figure 3:
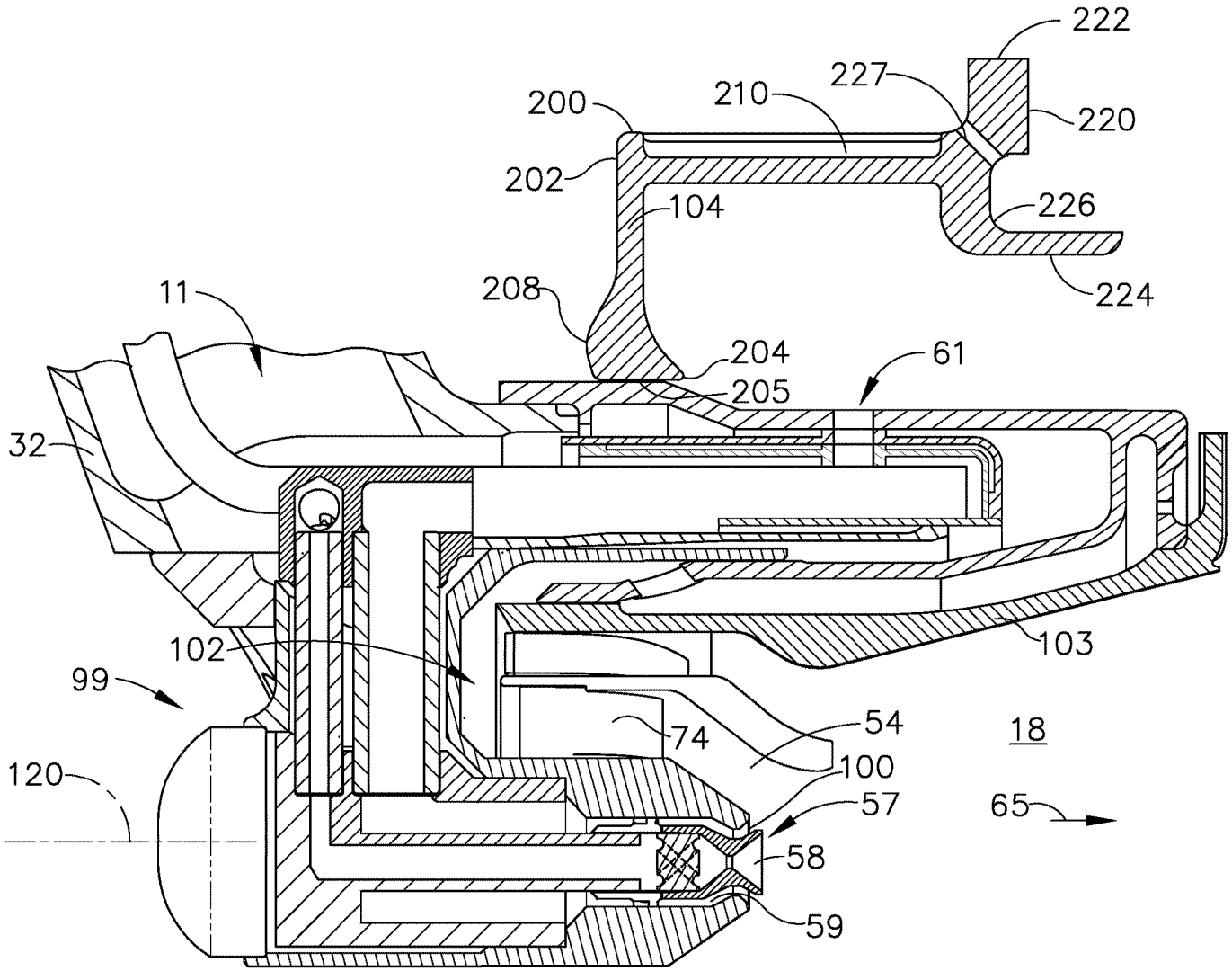
FIG. 3 is an enlarged cross-sectional view illustrating selected details of a fuel nozzle and the premixer of FIG. 2.

Referring to FIG. 2 and with further details shown in FIG. 3, the fuel nozzle assembly 12 includes a main fuel nozzle 61 and an annular pilot inlet 54 to the pilot mixer 102 through which the first portion 23 of the compressor discharge air 402 flows. The fuel nozzle assembly 12 further includes a dual orifice pilot fuel injector tip 57 substantially centered in the annular pilot inlet 54. The dual orifice pilot fuel injector tip 57 includes concentric primary and secondary pilot fuel nozzles 58, 59. The pilot mixer 102 includes a centerline axis 120 about which the dual orifice pilot fuel injector tip 57, the primary and secondary pilot fuel nozzles 58, 59, the annular pilot inlet 54 and the main fuel nozzle 61 are centered and circumscribed.

A pilot housing 99 includes a centerbody 103 and radially inwardly supports the pilot fuel injector tip 57 and radially outwardly supports the main fuel nozzle 61. The centerbody 103 is radially disposed between the pilot fuel injector tip 57 and the main fuel nozzle 61. The centerbody 103 surrounds the pilot mixer 102 and defines a chamber 105 that is in flow communication with, and downstream from, the pilot mixer 102. The pilot mixer 102 radially supports the dual orifice pilot fuel injector tip 57 at a radially inner diameter ID and the centerbody 103 radially supports the main fuel nozzle 61 at a radially outer diameter OD with respect to the engine centerline 52. The main fuel nozzle 61 is disposed within the premixer 104 (See FIG. 1) of the mixer assembly 40 and the dual orifice pilot fuel injector tip 57 is disposed within the pilot mixer 102. Fuel is atomized by an air stream from the pilot mixer 102 which is at its maximum velocity in a plane in the vicinity of the annular secondary exit 100.

Figure 4A:
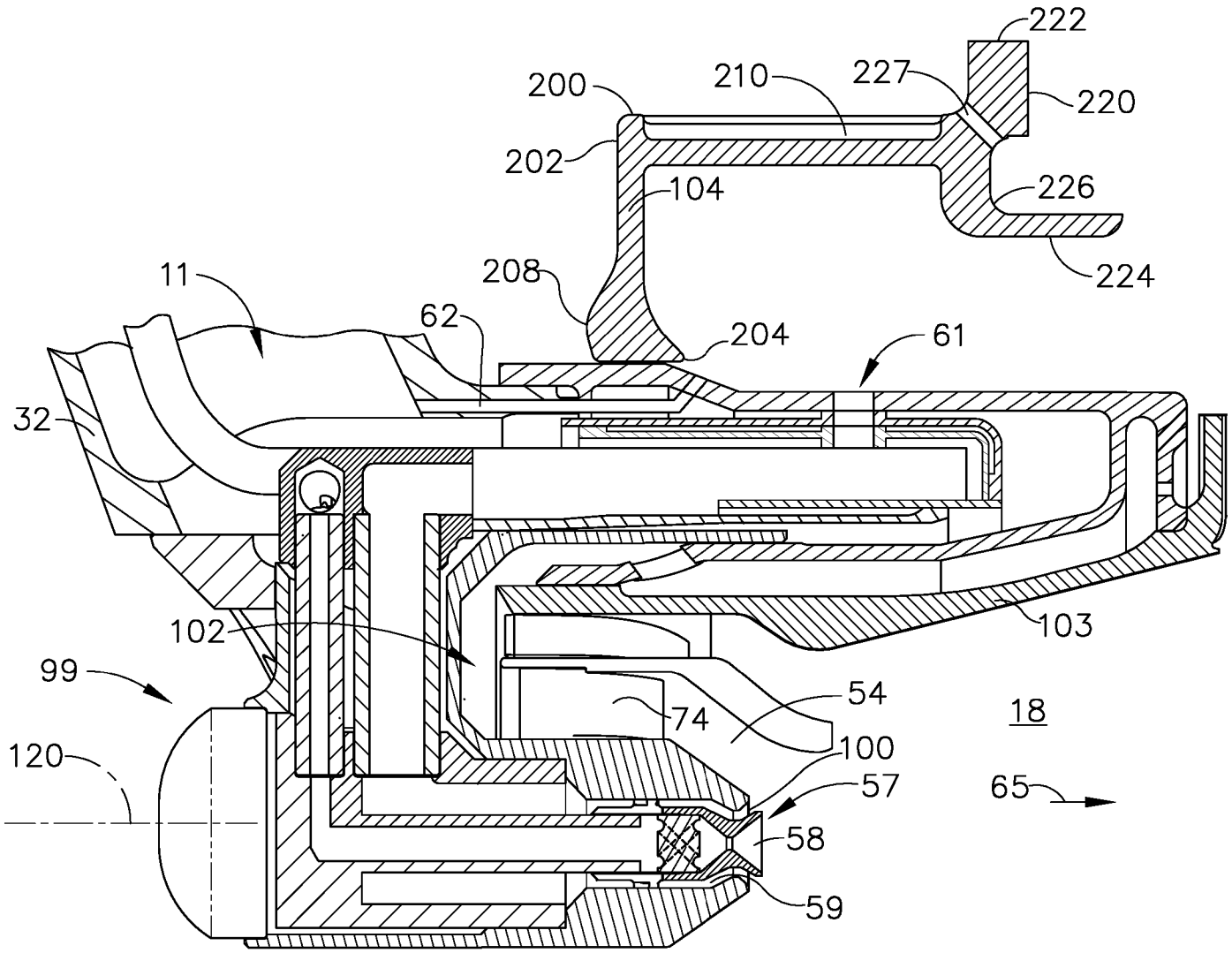
FIG. 4*a* is an enlarged cross-sectional view illustrating selected details of an alternative fuel nozzle and premixer.
Figure 4B:
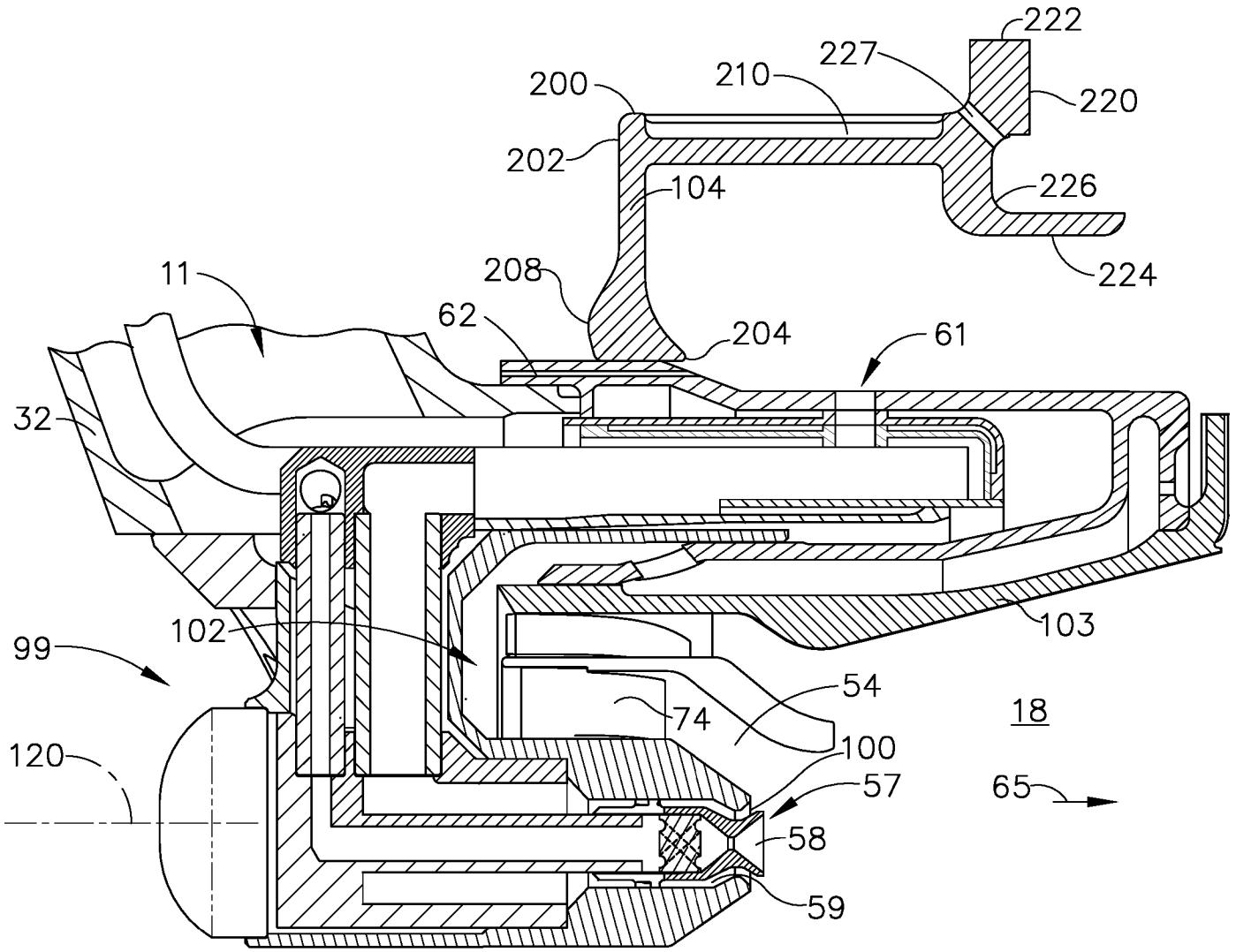
FIG. 4*b* is an enlarged cross-sectional view illustrating selected details of another alternative fuel nozzle and premixer.
Figure 5:
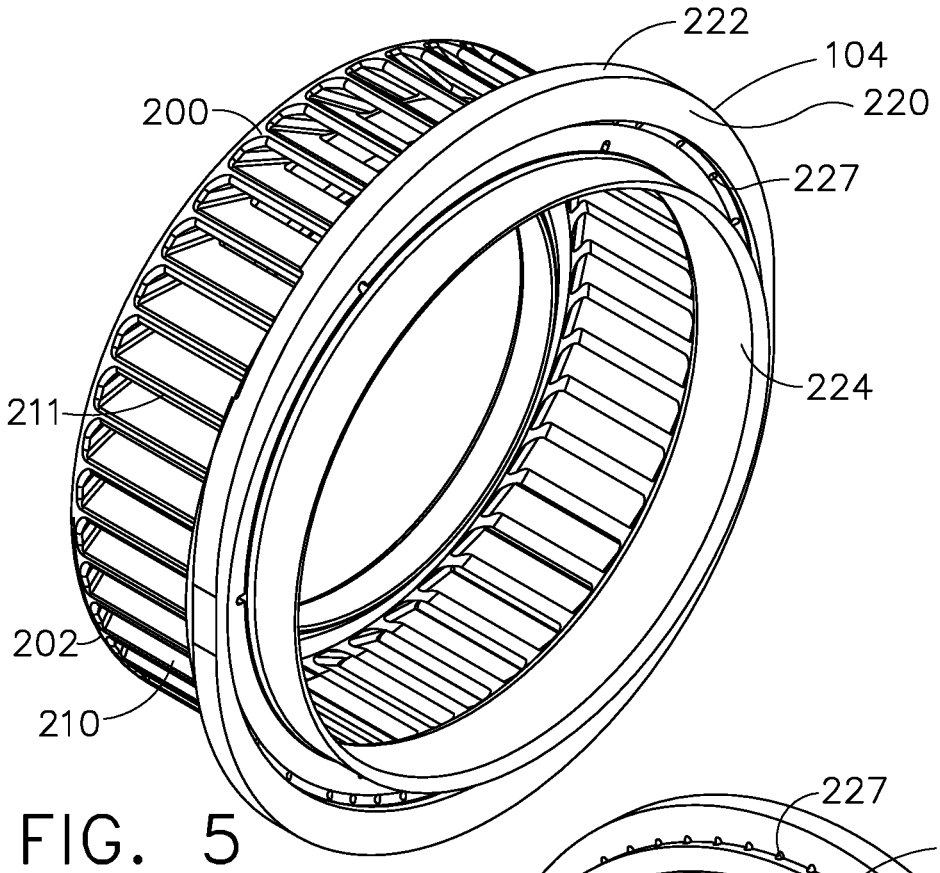
FIG. 5 is a perspective view of an aerodynamically enhanced premixer.
Figure 6:
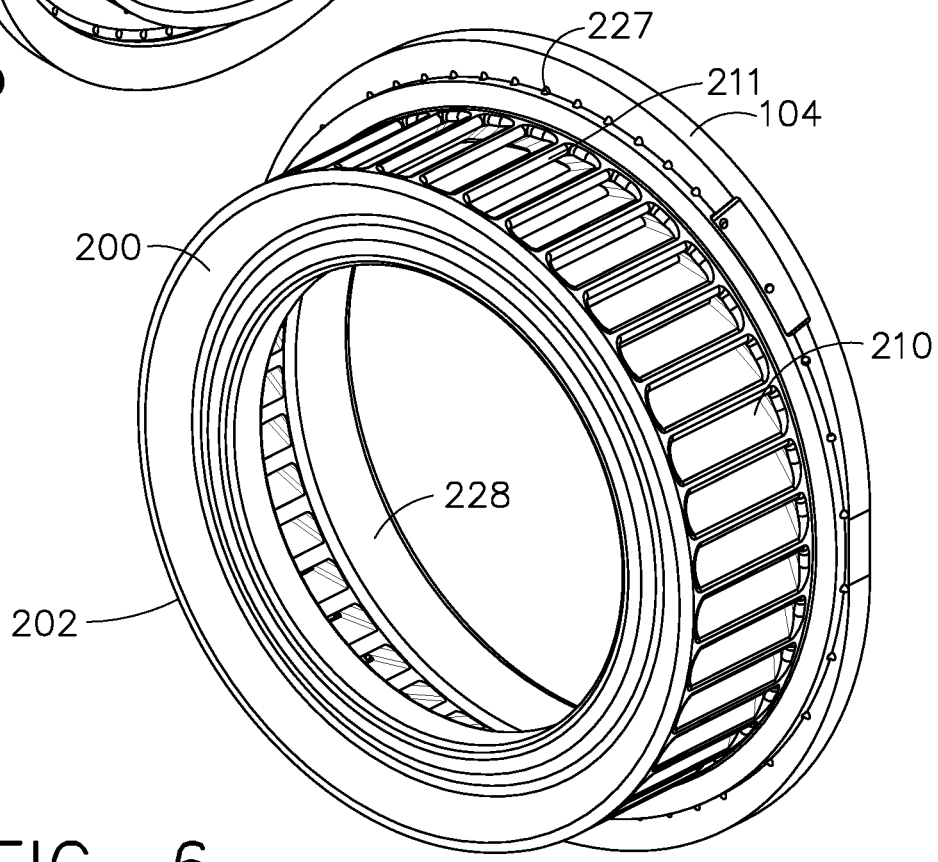
FIG. 6 is another perspective view of the aerodynamically enhanced premixer of FIG. 5.
Figure 7:
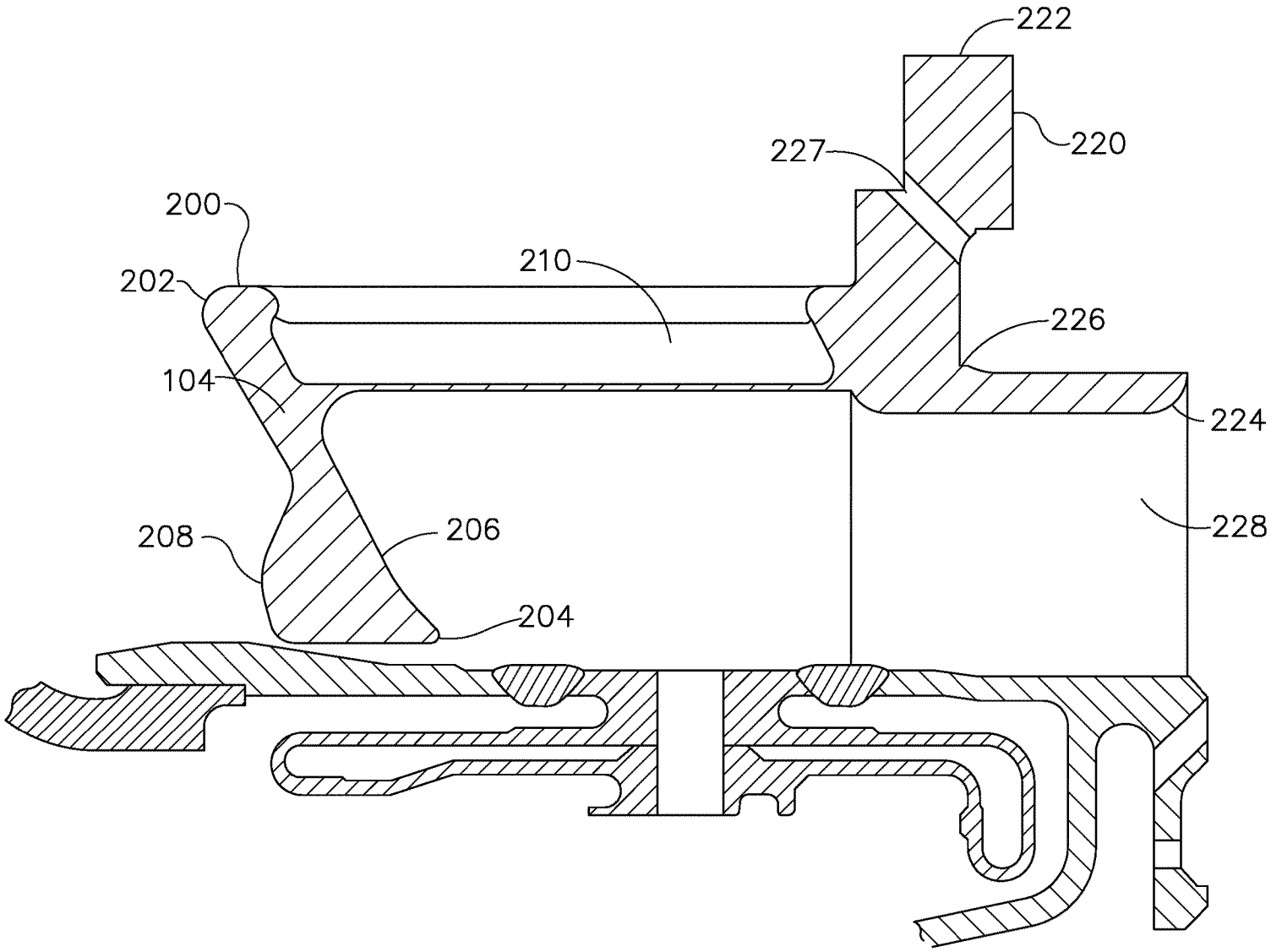
FIG. 7 is a cross-sectional view showing selected details of the aerodynamically enhanced premixer of FIG. 5.

With reference to FIGS. 4*a* and 4*b*, embodiments and alternatives are provided having an airstream passage being a nozzle slot 62 disposed within the structure of the nozzle 61 thereby allowing fluid communication between selected structure of the fuel injector 11. Selected structure includes but is not limited to the hollow stem 32.

Turning our attention to the premixer 104 and with reference to FIG. 3 and also to FIGS. 5-9, the premixer 104 is generally cylindrical in form and is defined by the relationship in physical space between a first ring 200, a second ring 220, and a plurality of radial vanes 210. In further detail, embodiments include those wherein the first and second rings 200, 220 are found to be generally equidistant, one from the other, at all points along their facing surfaces. If the first ring 200 is considered to lie largely within a single plane, then the second ring 220 is offset in physical space such that the plane it occupies is general parallel to the plane of the first ring 200. By continued reference to the figures, it can then be seen that the radial vanes 210 connect the first ring 200 to the second ring 220 and thereby form the premixer 104.

Alternatives are provided for which the generally equidistant and parallel-plane nature of the rings 200, 220 is not required. For such embodiments the rings 200, 220 are contemplated to not be disposed in generally parallel planes.

Additional embodiments and alternatives provide premixers 104 having a variety of additional structure, cavities, orifices and the like selectably formed or provided, as desired in order to provide enhanced fuel efficiency along with reduced emissions in combustion. Several alternatives have been selected for illustration in FIGS. 8-31; however, the embodiments illustrated are intended to be viewed as exemplars of a much wider variety of embodiments and alternatives.

With reference once more to FIGS. 3 and 7, alternatives include those wherein first ring 200 has a first ring outer diameter and a first ring inner diameter as generally measured at first outer point 202 and first inner point 204, respectively. With specific reference to FIG. 3, a portion of the first ring 200 is illustrated as first inner ring platform 205. A first inner shoulder 206 and a first outer shoulder or "foot" 208 are found on some embodiments. The second ring 220 has a second ring outer diameter and a second ring inner diameter as generally measured at second outer point 222 and second inner point 224, respectively. A second inner shoulder 226 is located at a point, viewed in cross section, where the structure of second ring 220 moves through a generally right angle thereby forming a chamber 228 being generally cylindrical in alternative embodiments. One or more aft lip purge flow openings 227 are formed and disposed on ring 220, as desired. The chamber 228 is disposed in the premixer 104 generally apart from a region of the premixer 104 where the vanes 210 are located.

Recall that (see FIG. 2) the first portion 23 of the compressor discharge air 402 flows into the mixer assembly 40, being fluid compressed upstream in a compressor section (not shown) of the engine and routed into the combustor system. Such air 402 arrives from outside the mixer assembly 40 passing inward and being routed through the mixer 40 along shoulder 226 and onward through chamber 228 exiting to become a portion of fuel-air mixture 65.

By selectably altering the values for the respective diameters and distances between various elements of the pre mixer 104 so defined above, and as shown in FIGS. 7-31, embodiments are provided that present selected and desired physical structure into the flow path to optimize flow through the premixer 104. For example, premixers 104 as exemplified in FIGS. 5-9 provide generally for a longer chamber 228 than prior designs, thereby providing higher bulk axial velocity.

Figure 8:
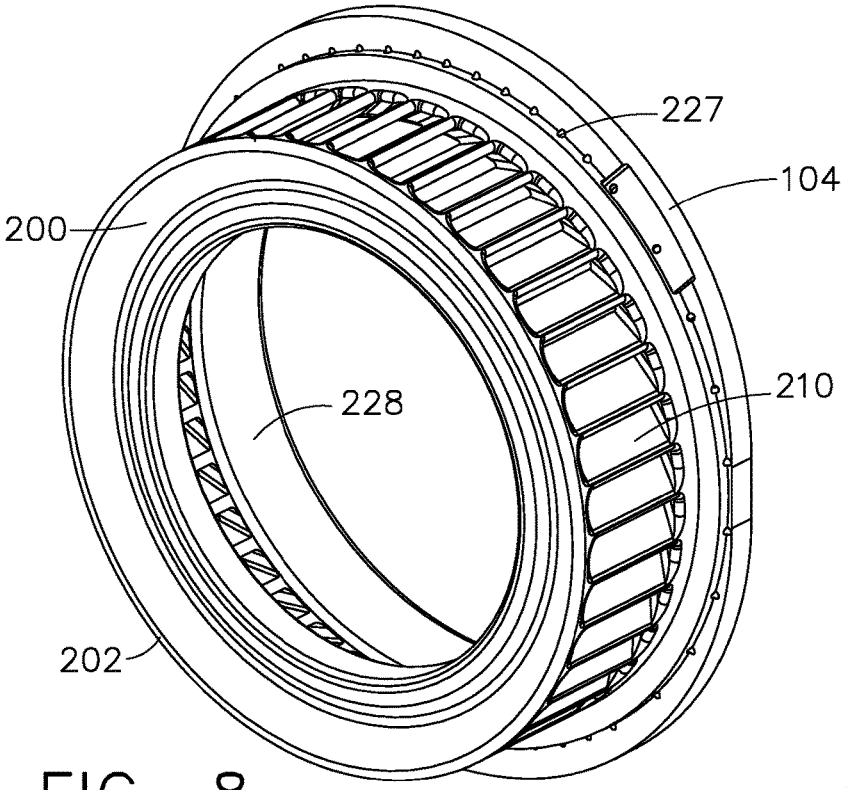
Figure 9:
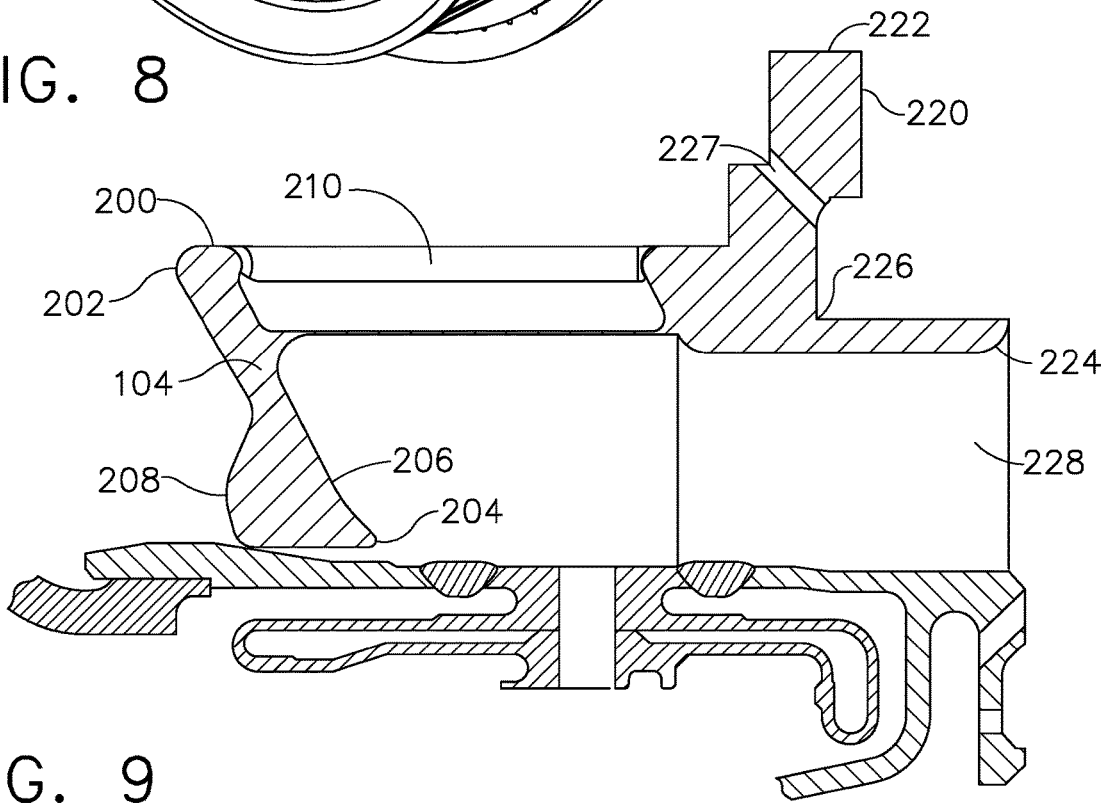
Figure 10:
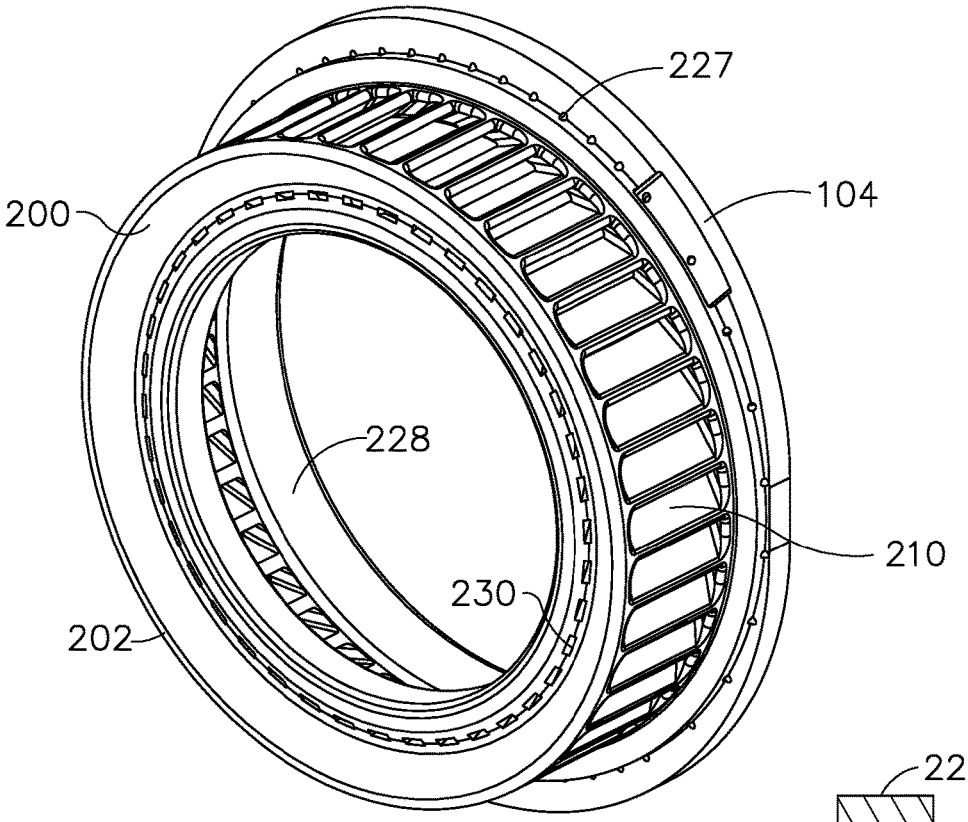
Figure 11:
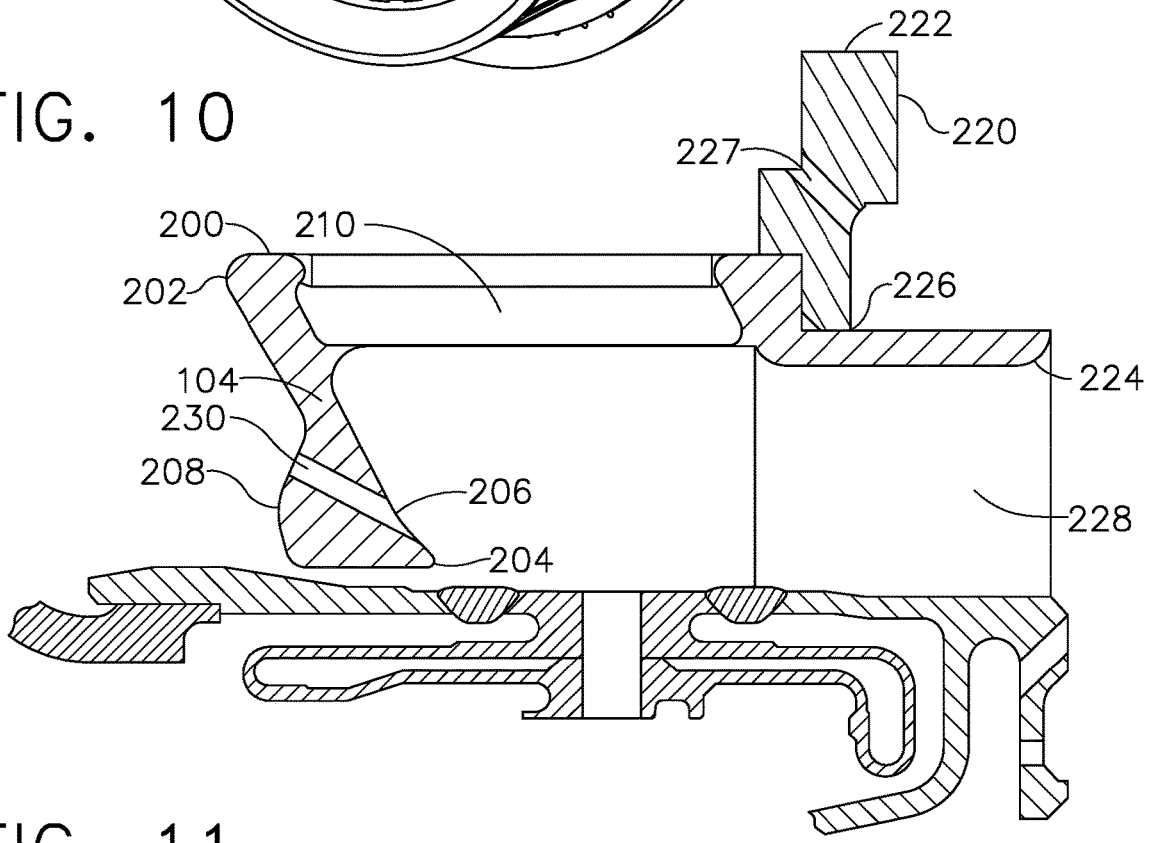
Figure 12:
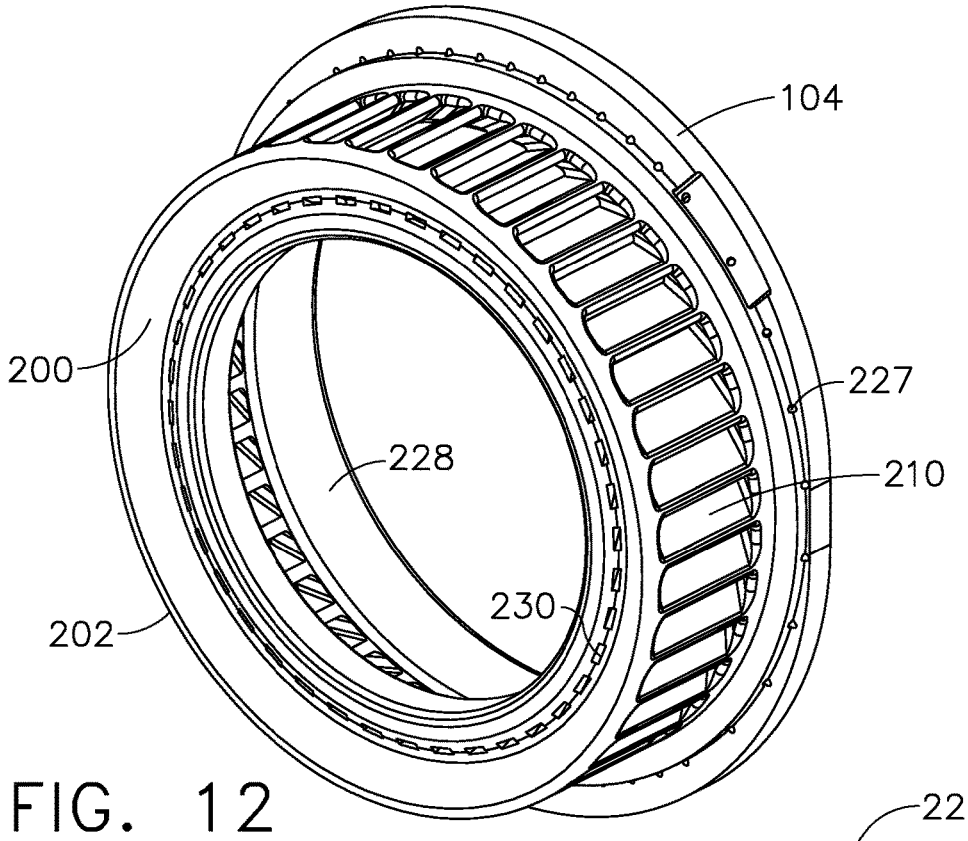

FIG. 8 shows a perspective view of an embodiment and FIG. 9 shows a sectional view of that same embodiment. The succeeding pairs of FIGS. 10-11, 12-13*a*, 14-15, 16-17, 18-19, 20-21, 22-23, 24-25, 26*a*-27, 28-29 and 30-31, provide those views, each pair for a different illustrative embodiment and alternative premixer 104. Figure set 26*a*-26*c* uses three views to illustrate details for alternatives that include a splitter 240. For succeeding figures that also include a waveform 242, reference is directed back to FIGS. 26*a*-26*c* for splitter 240 details.

With reference to FIGS. 10-19 premixers exemplified provide for the addition of purge slots 230 to the structure of those premixers 104 as exemplified in FIGS. 5-9. These slots 230 assist in energizing the boundary layer on the centerbody 103 (see FIG. 4).

Figure 13A:
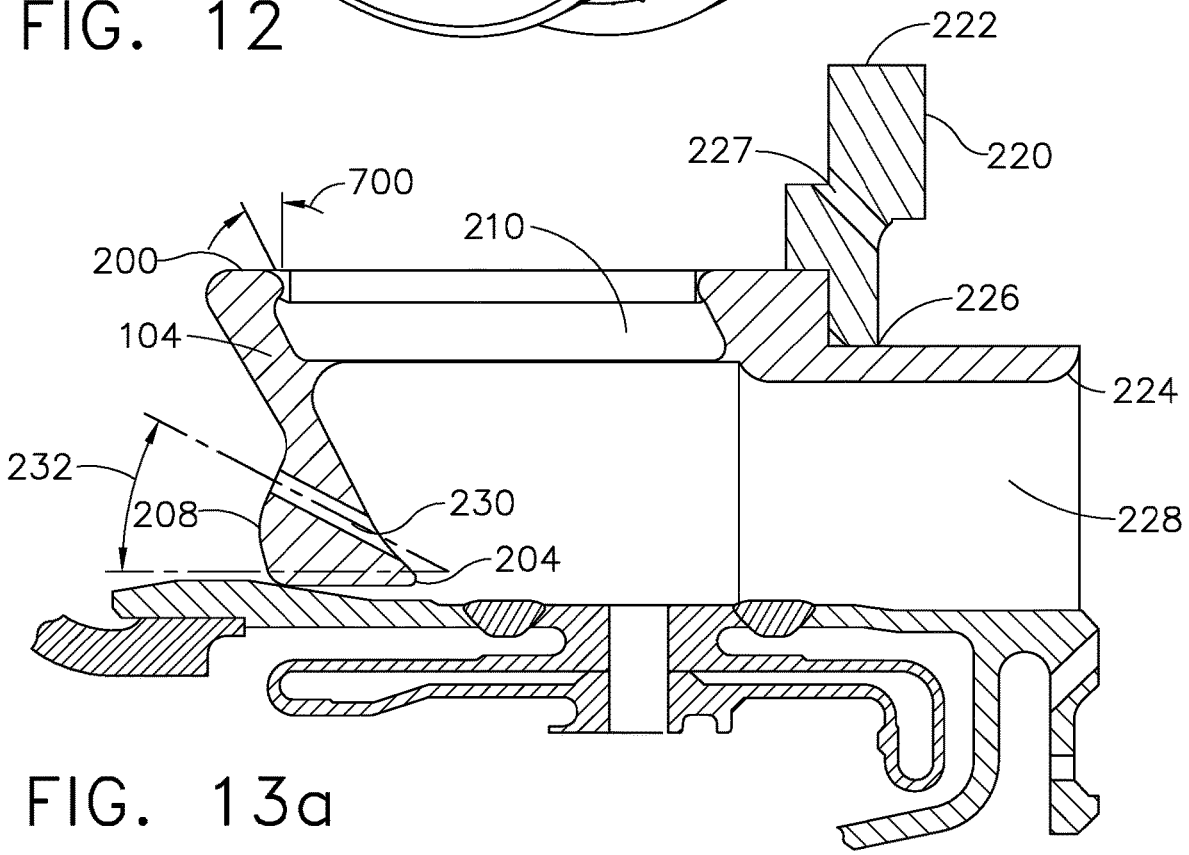

With reference to FIG. 13*a* and also shown in FIG. 17, alternative premixers 104 include a tilt angle 700 provided as follows:

It can be seen that if the first inner point 204 is displaced axially inward into the main mixer 104 as compared to the location of the first outer point 202, then the shoulder 206 is also found to be incorporated into embodiments so formed. If the shoulder 206 is generally co-located with first outer point 202, then a generally sloping contour is presented along an inner surface of first ring 200.

In cross-sectional view (see FIGS. 13*a* and 19), the tilt angle 700 is readily seen as measured between a line tracing the generally sloping contour along the inner surface of first ring 200 and a line drawn radially outward from a centerline of the injector 11. Alternatives are provided that have the shoulder disposed at some location inboard from first outer point 202 and consequently closer to first inner point 204. By reference to the cross-sectional view, the tilt is presented to the air 402 as it arrives into the premixer 104. Such tilt 700 assists in enhancing the efficiency and reducing aerodynamic losses associated with providing a flow 402 pattern with reduced changes in angular direction when viewed from the side in cross section. Such an aerodynamic package results in enhanced boundary layer control, improved proximity and reduced stack sensitivity. The means for tilt 700 provides control of boundary layer, optimizes swirler packaging, provides robust mixing by reducing eccentricity and allows for reduction in the size of the mixer cavity 228.

With reference to FIGS. 10-23, embodiments and alternatives provide for second ring 220 being formed separately from premixer 104 wherein second ring 220 is mated to corresponding structure, the associated two-part assembly thereby becoming premixer 104.

FIGS. 10-27 also illustrate embodiments and alternatives having a plurality of purge slots 230 disposed as desired and formed within first ring 200.

FIGS. 26*a*-31 provide exemplars of premixer 104 embodiments for which one or more splitters 240 are provided, disposed generally within the vanes 210. Such embodiments provide enhanced aerodynamic efficiency of flow 402. In addition, alternatives exemplified in FIGS. 26*a*-31 also include a waveform 242 formed and disposed upon the splitter 240 in order to further enhance the aerodynamic efficiency of flow 402.

With reference to FIGS. 18-23, premixers exemplified provide for a shorter premixer 104 with concurrently shorter radial vanes 210 and having a longer chamber 228 wherein an inner peak velocity profile is maximized.

With reference to FIGS. 26*a*-31, premixers exemplified provide for further distinctions over alternative premixers 104.

Figure 26A:
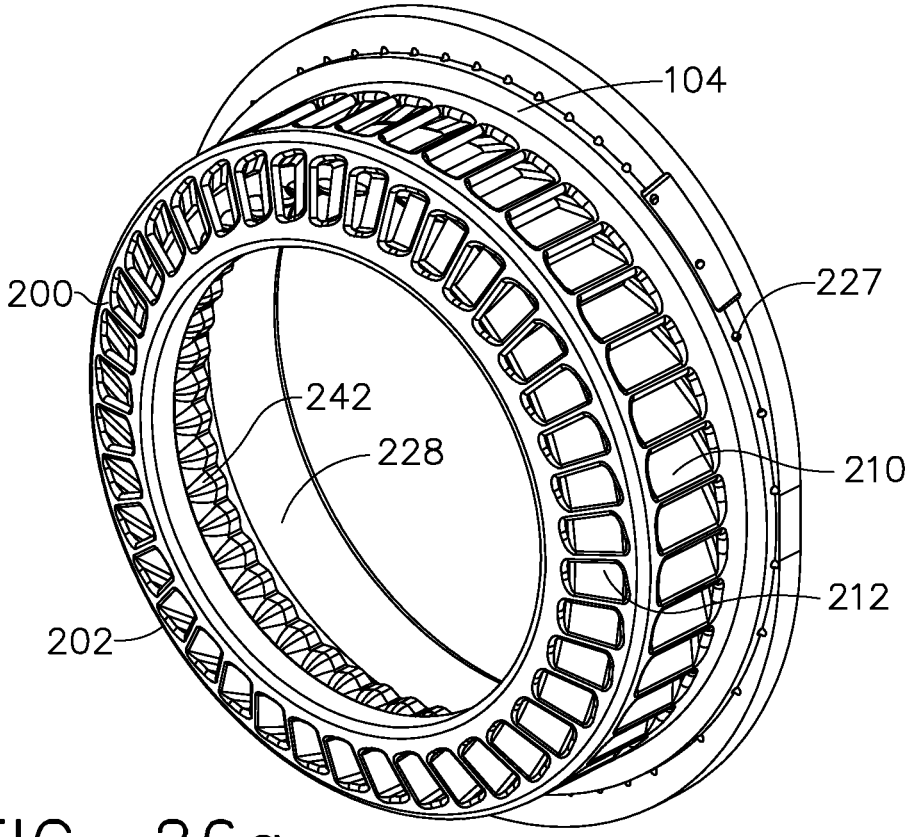
FIGS. 26*a*, 26*b*, and 27 provide a set of three views, the first view shown in perspective, the second view in another perspective and the third view in sectional, the set of views chosen to illustrate selected details for chevron splitters of alternative embodiments of an aerodynamically enhanced premixer.
Figure 26B:
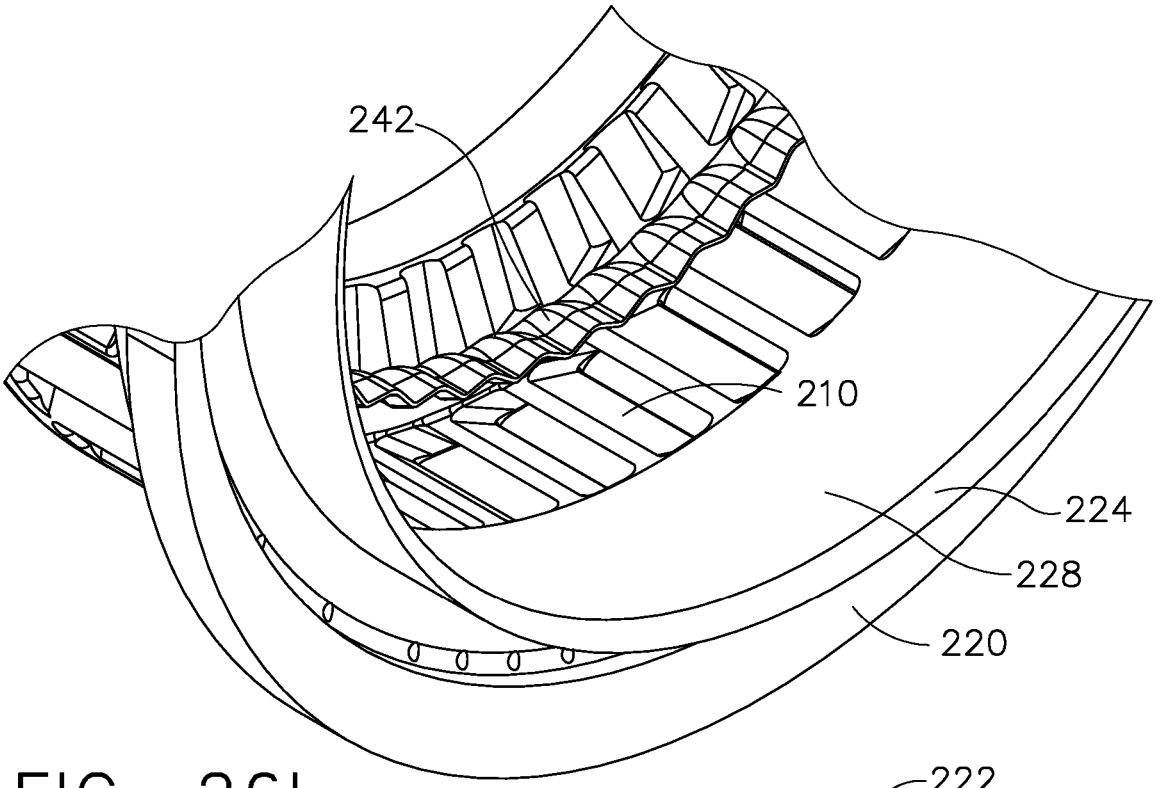
Figure 27:
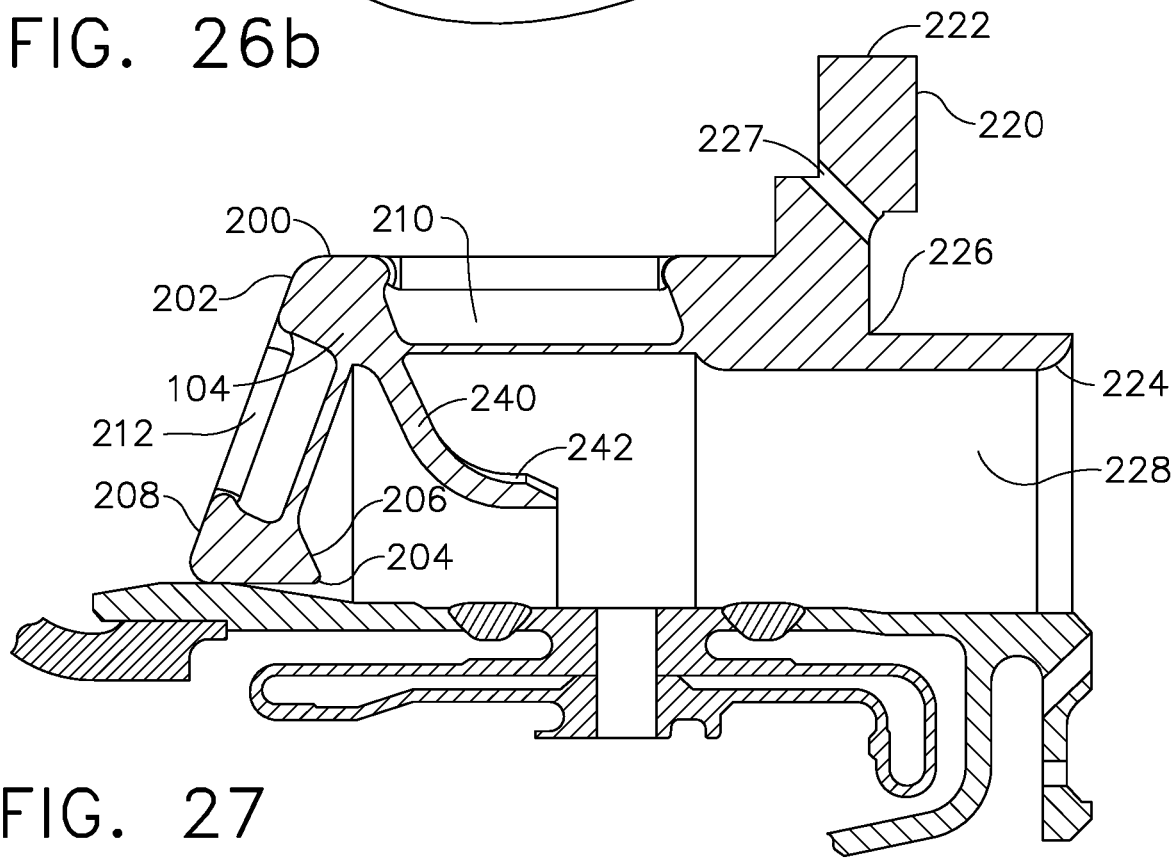
Figure 28:
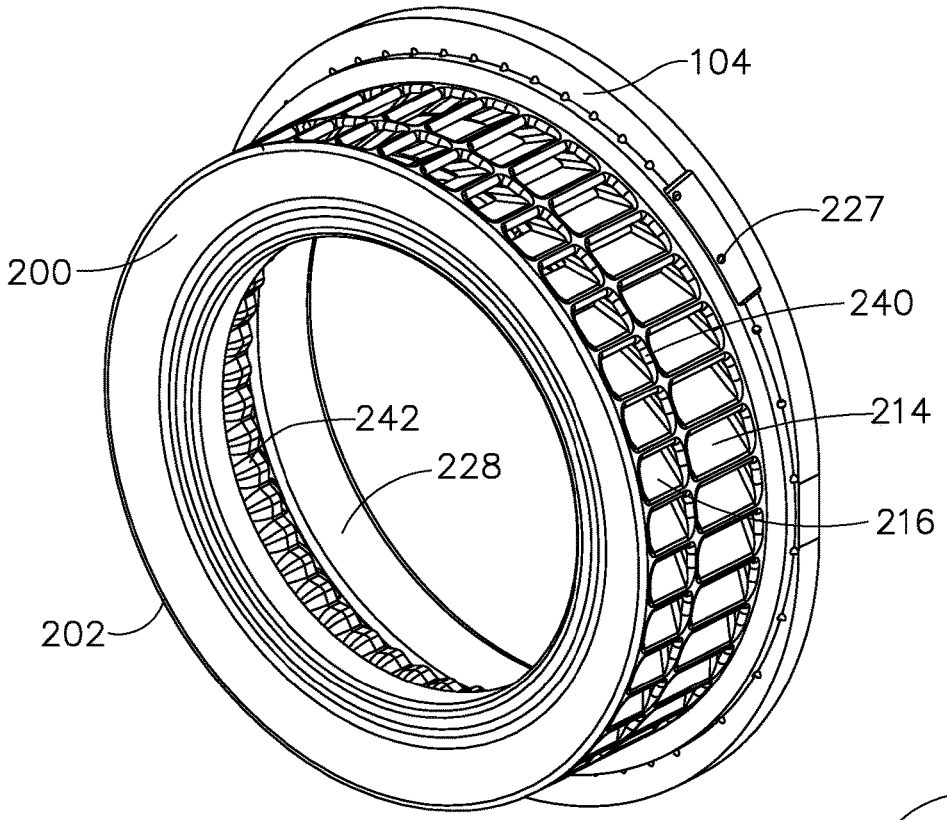
Figure 29:
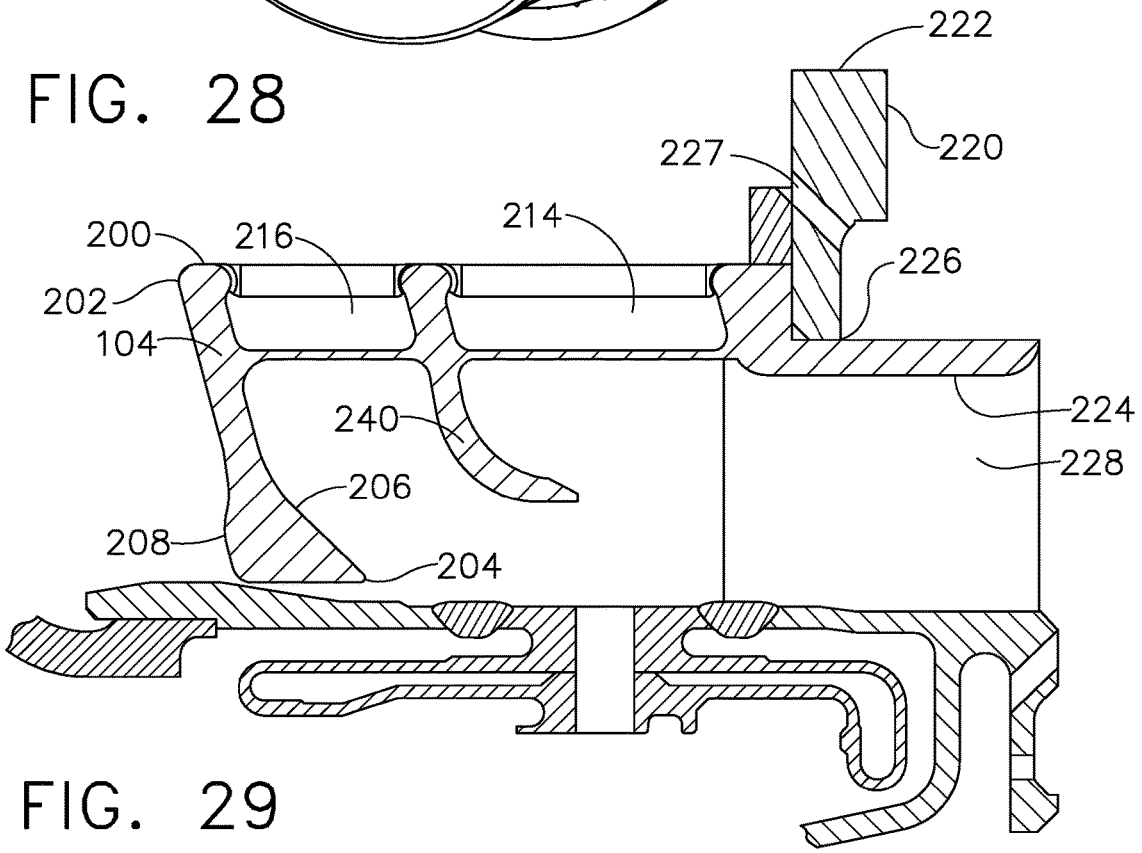
Figure 30:
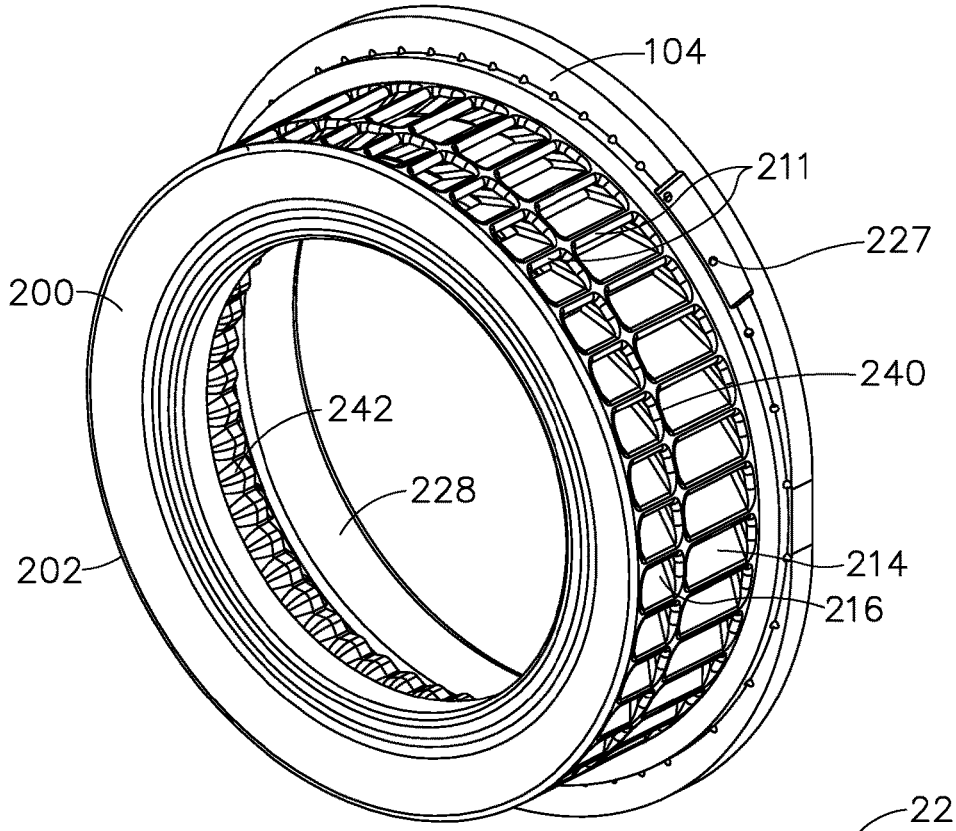
Figure 31:
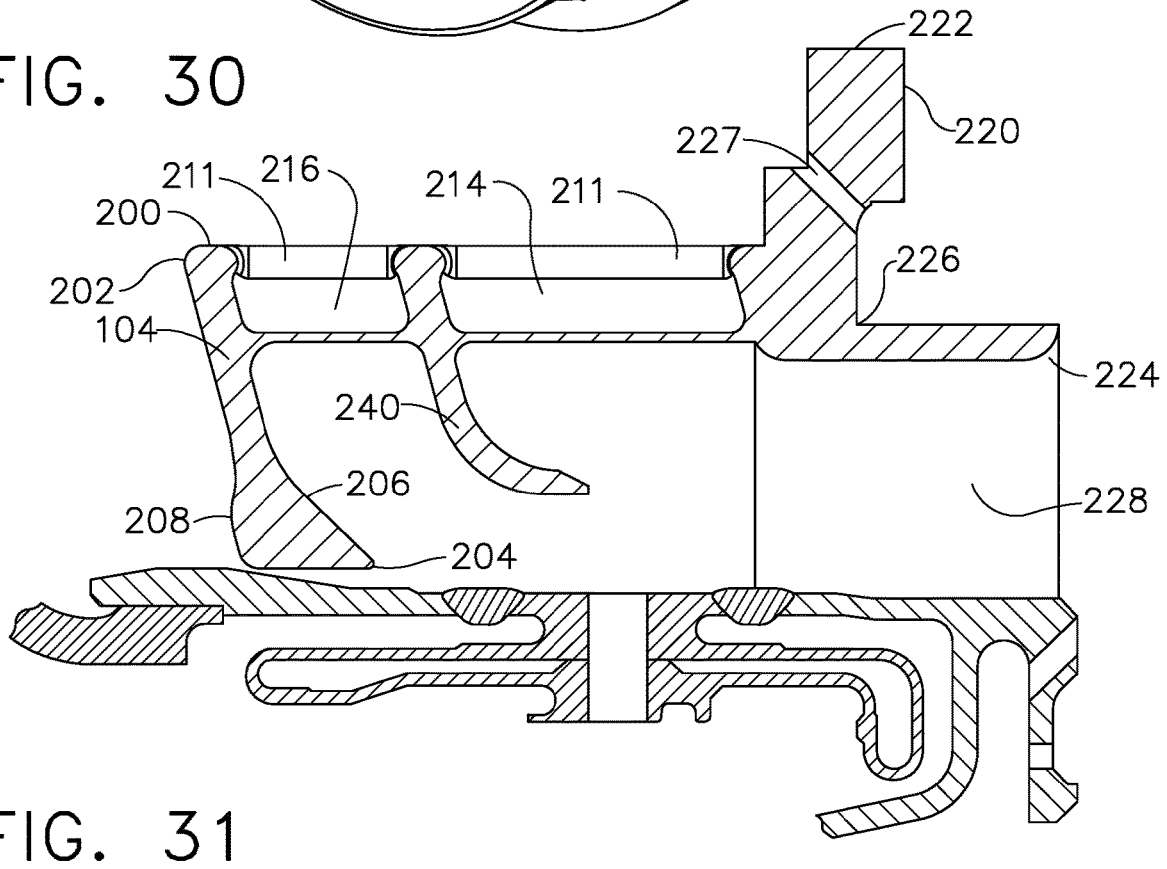

Specifically, with reference to FIGS. 26*a*, 26*b* and 27, in addition to the radial vanes 210 of alternatives exemplified in other Figures, conical vanes 212 are formed generally upon the first ring 200 and depending radially inward therefrom. In addition, the one or more splitters 240 are provided generally radially inboard of a shorter premixer 104 with concurrently shorter radial vanes 210 and having a longer chamber 228 wherein an inner peak velocity profile is maximized.

With reference to FIGS. 28-31, the one or more splitters 240 are located axially between the first ring 200 and the second ring 220 and interposed along the length of what has been heretofore shown as the radial vane 210 of other alternatives (See, for example, FIGS. 26*a*, 26*b* and 27). As such, the embodiments exemplified in FIGS. 28-31 replace the radial vane 210 with two radial vanes: a forward radial vane 216 disposed between the first ring 200 and the splitter 240, and an aft radial vane 214 disposed between the splitter 240 and the second ring 220. Such embodiments are shown to enhance low emission operation while also raising the potential for dynamic air flow. Other embodiments provide that in place of one or more of the radial vanes 210, the one or more conical vanes 212 are formed generally upon the first ring and depending radially inward therefrom.

Further embodiments provide the waveform 242 disposed upon the splitter 240 thereby further enhancing low emission operation while also raising the potential for dynamic air flow. Some waveforms 242 are formed in the shape of a chevron. With respect to vanes 210, forward radial vanes 216 and aft radial vanes 214, as found on any particular embodiment, some alternatives provide for abrupt profile changes along a surface path as seen in viewing a transition from structure nearby but apart from these vanes 210, 214, 216. For example, in some embodiments, the vanes 210, 214, 216 are formed by stamping or other operations involving cutting and bending. In further detail with respect to this example not meant to be limiting, embodiments include those that show vanes having approximately 90 degree angles of transition corresponding to a transition radius being very close to zero—blunt edges, more or less. Alternatives include those wherein the vanes 210, 214, 216 feature a less abrupt transition, that transition being instead a radiused transition. The transition radius for such vanes 210, 214, 216 is an inlet radius 211. Alternatives include those wherein the inlet radii 211 are within a range of from 0.010 inches to 0.030 inches. Even further alternatives feature both abrupt and radiused transitions with respect to the vanes 210, 214, 216.

Referring back to the nozzle 61 with details shown in FIGS. 3, 4*a* and 4*b*, embodiments and alternatives of premixers 104 are provided wherein additional boundary layer control is realized using slots to include purge slots 230 and/or nozzle slots 62 disposed at either or both of the foot 208 of the premixer 104 or along an outer diameter of the nozzle 61, respectively. With reference to FIG. 4*b*, alternatives include those wherein the air stream passages are formed as more than one nozzle slot 62 allowing additional air to pass through the nozzle 61 in proximity to but radially inward from the foot 208 of the premixer 104.

Figure 13B:
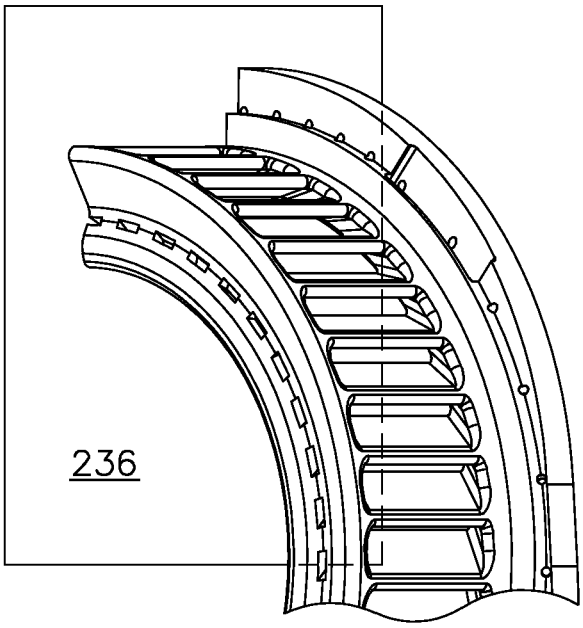
FIGS. 13*b* and 13*c* illustrate selected details for purge slots of an aerodynamically enhanced premixer.
Figure 13C:
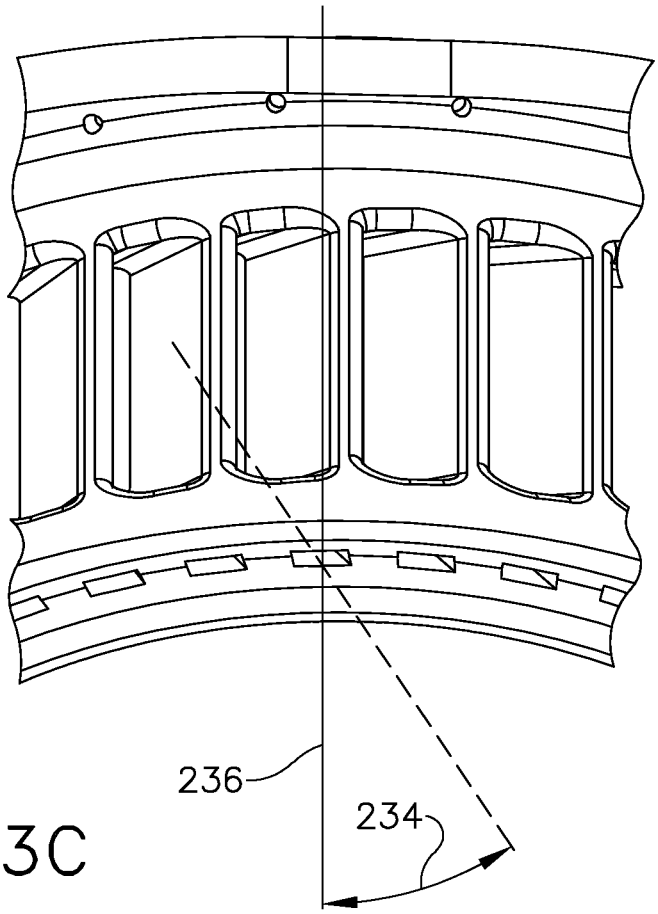
Figure 14:
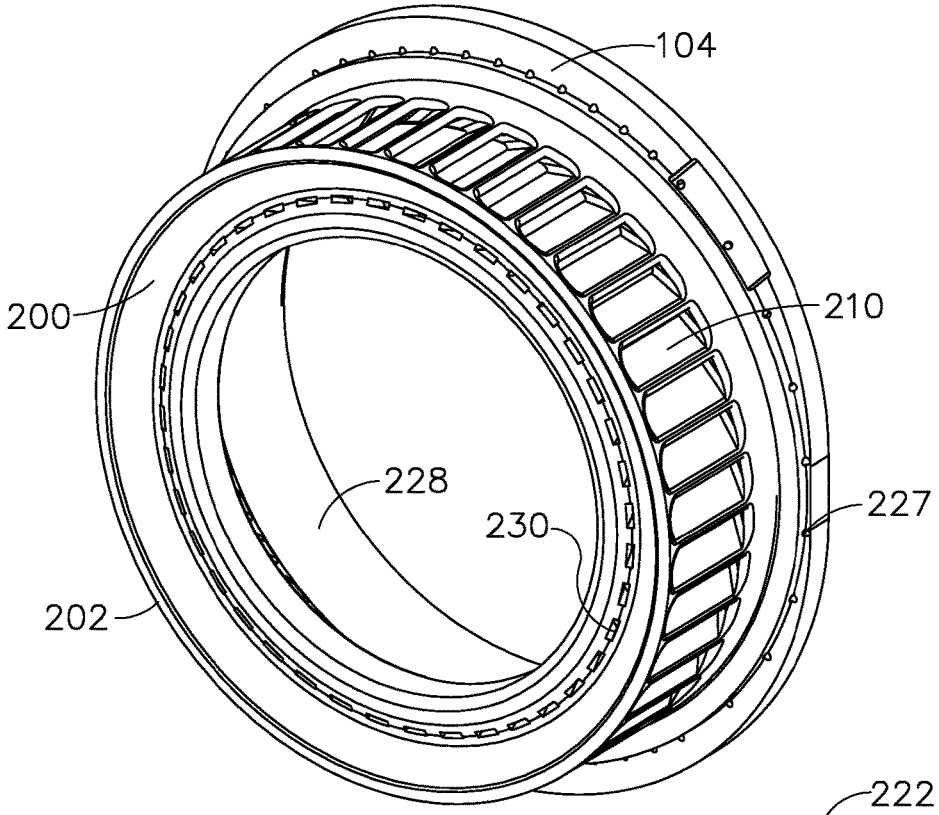
Figure 15:
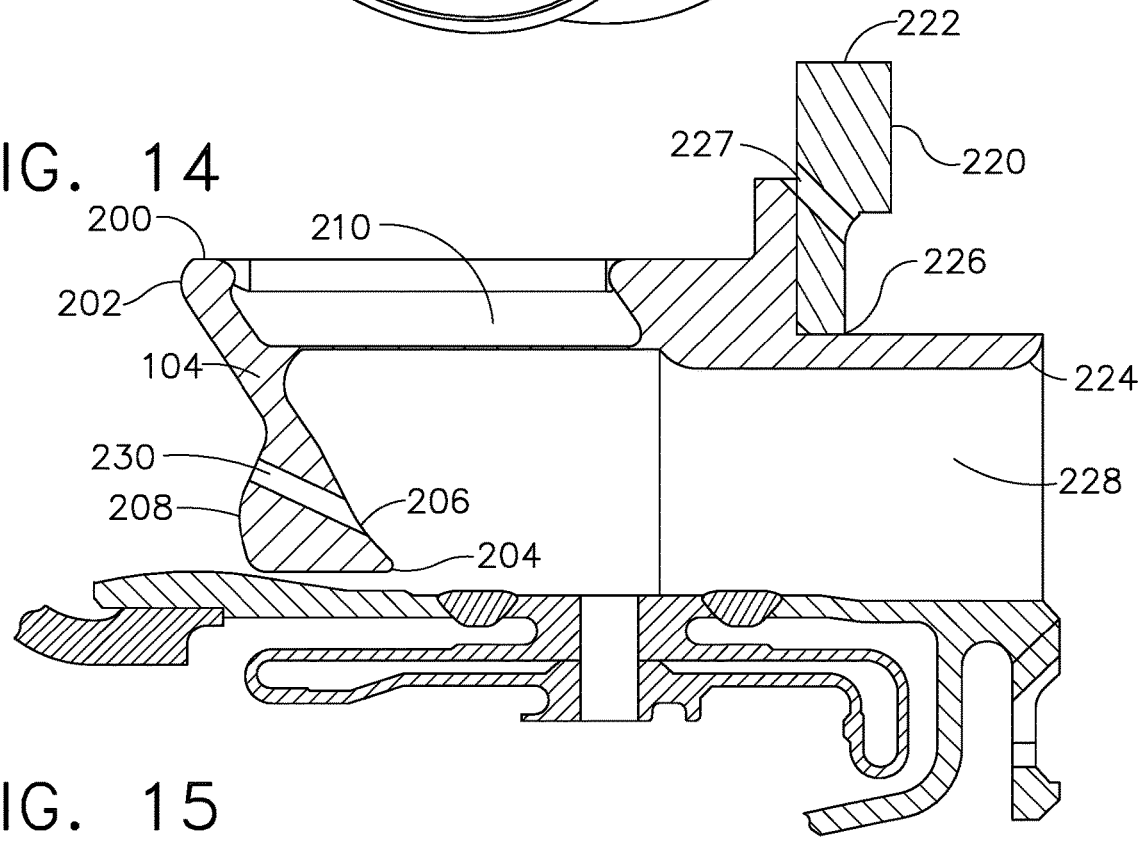

For embodiments having purge slots 230 and with reference to FIGS. 13*a*, 13*b* and 13*c*, alternatives provide for the purge slots to be formed in geometries that incorporate either, both, or none of a radial angle 232 (as shown in FIG. 13*a*) and a circumferential angle 234. With regard to the circumferential angle 234 and with reference to FIGS. 13*b* and 13*c*, a plane 236 is shown in a perspective view of the premixer 104 in FIG. 13*b*. It is with reference to the plane 236 in FIG. 13*c* that the circumferential angle 234 is seen. The viewpoint of FIG. 13*c* is within the plane 236, therefore the plane 236 appears to be a vertical line from 6 o'clock to 12 o'clock in that view. The circumferential angle 234 is taken from plane 236 to a line extending along the face of a selected structural portion within the purge slot 230 as shown in FIG. 13*c*. Alternatives include those wherein the radial angle is within a range of from about 0 degrees to about 45 degrees. Alternatives include those wherein the circumferential angle is within a range of from about 0 degrees to about 60 degrees. Embodiments include those wherein a count of all purge slots is the same as a count of all vanes.

Figure 16:
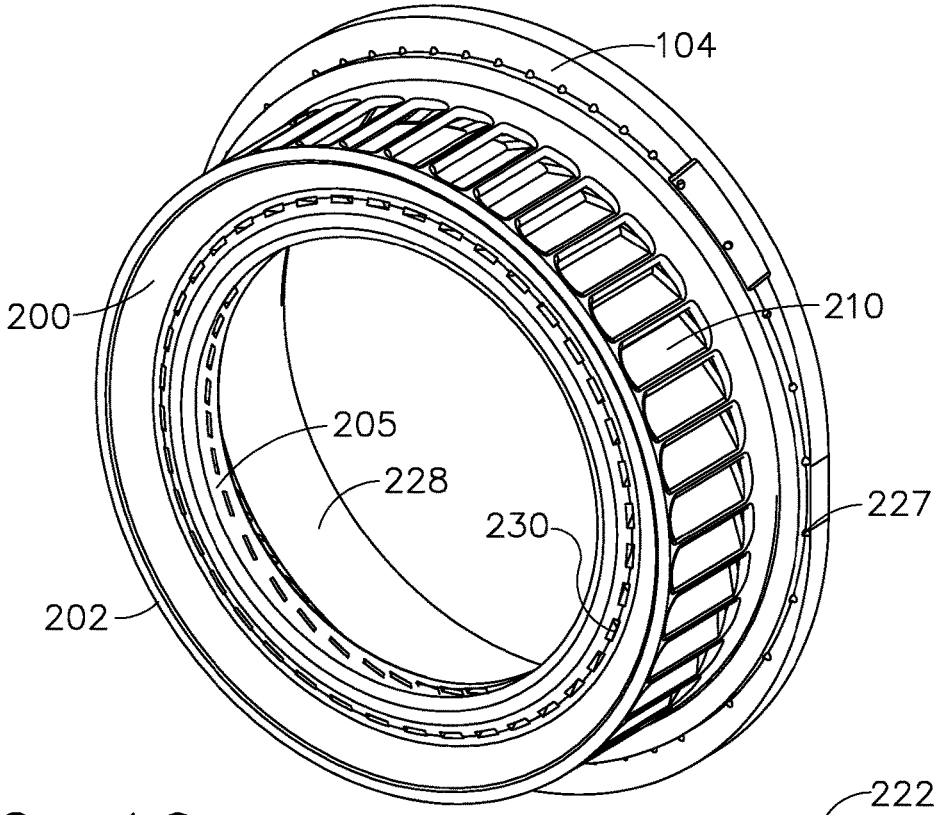

Alternatives provide for selected disposition or alignment of the purge slots 230. For example, with reference to FIGS. 15 and 16, alternatives provide that the purge slots 230 discharge within an area that illustrated as in-between the first inner point 204 and the first inner shoulder 206. With reference to FIGS. 16 and 17, other embodiments provide instead that the purge slots 230 discharge not within an area defined by the first inner point 204 and the first inner shoulder 206 but instead, the purge slots 230 discharge radially further inward and thereby along the first inner ring platform 205.

Other alternatives provide for circumferential purge by other selections for alignment of the purge slots 230. Embodiments also provide for variable axial purge by selections for alignment of the purge slots 230 and also by selection of shape of the first ring 200 to include shape and location of first outer shoulder 208. Purge slots 230 provide for localized boundary layer control. When combined with a tilt angle 700, purge slots 230 also provide a focused and energized boundary layer. When variable axial purge is utilized, the premixer 104 enjoys a reduction of sensitivity to leakage variations sometimes seen circumferentially around the premixer 104. Variable axial purge also allows for purge to be reduced at low power.

Figure 18:
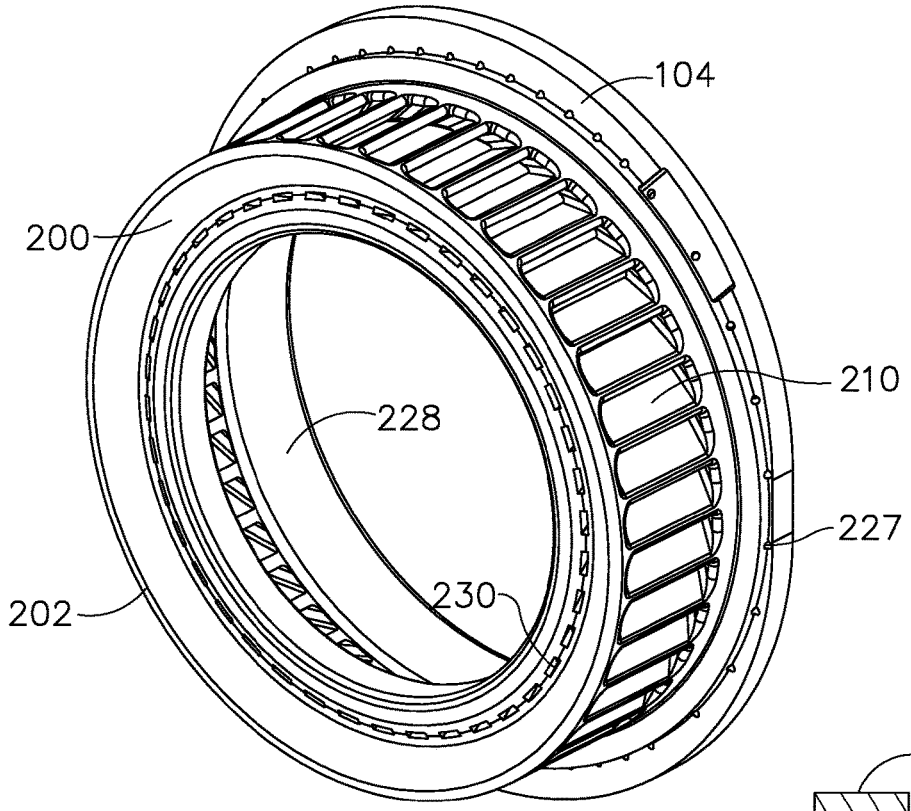
Figure 19:
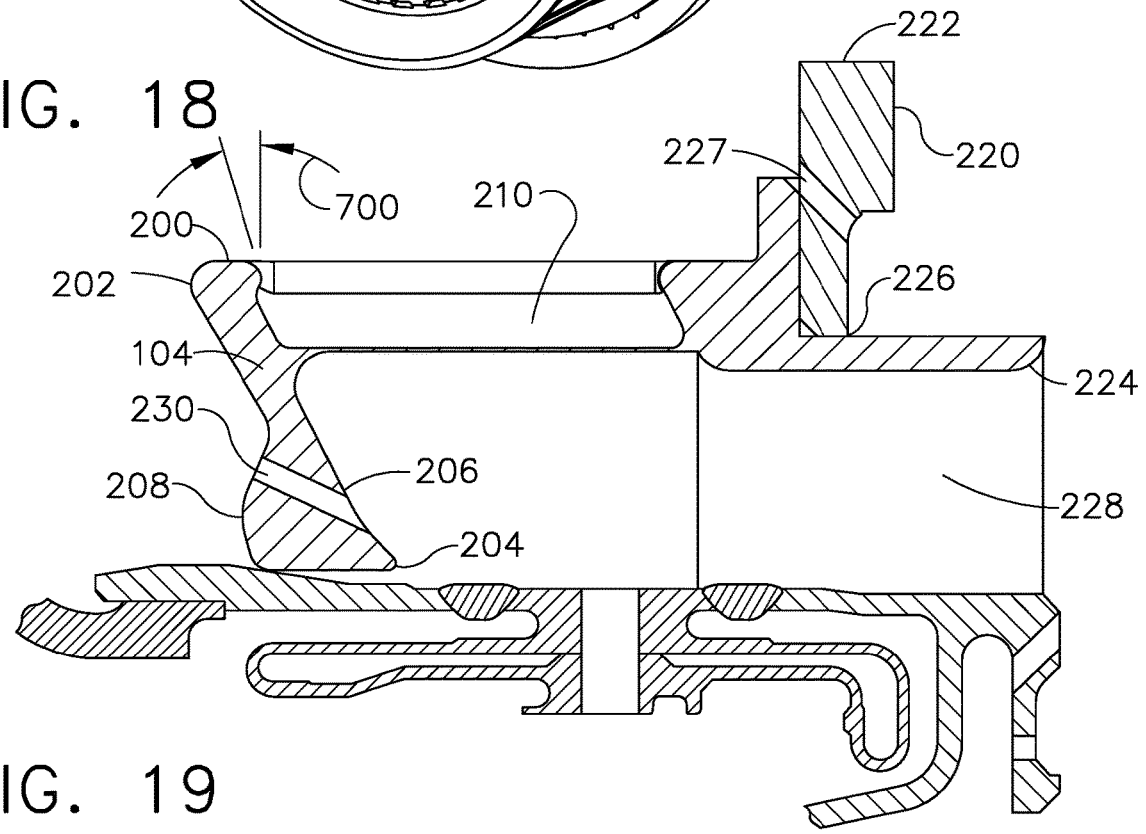
Figure 20:
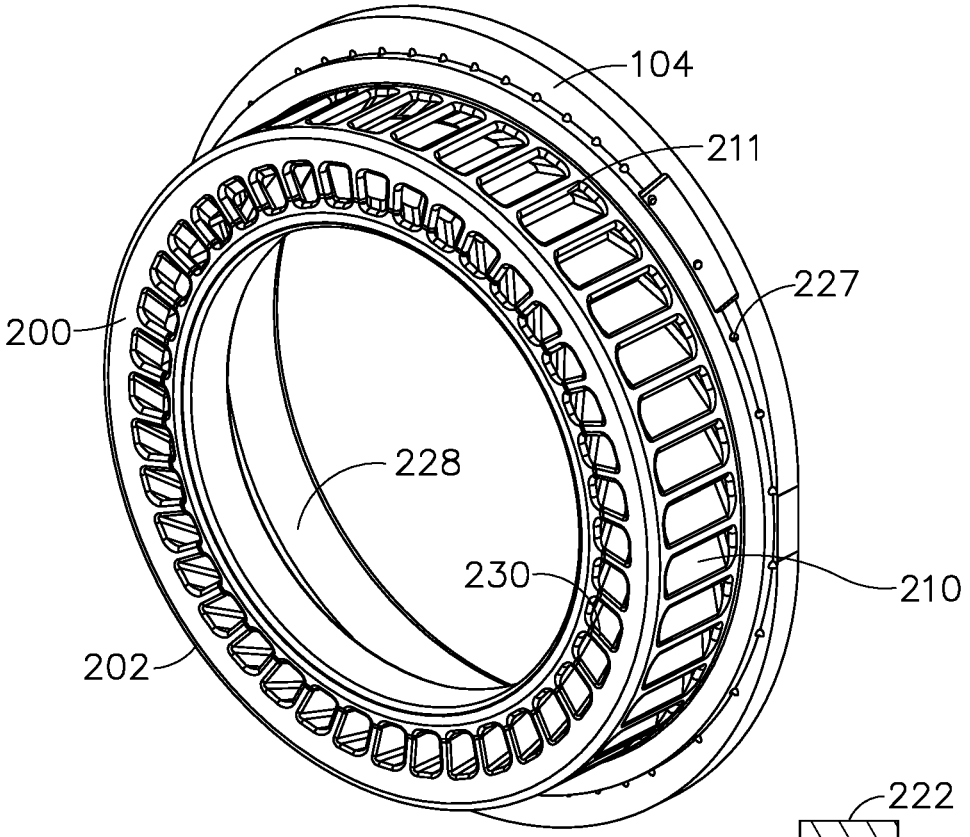
Figure 21:
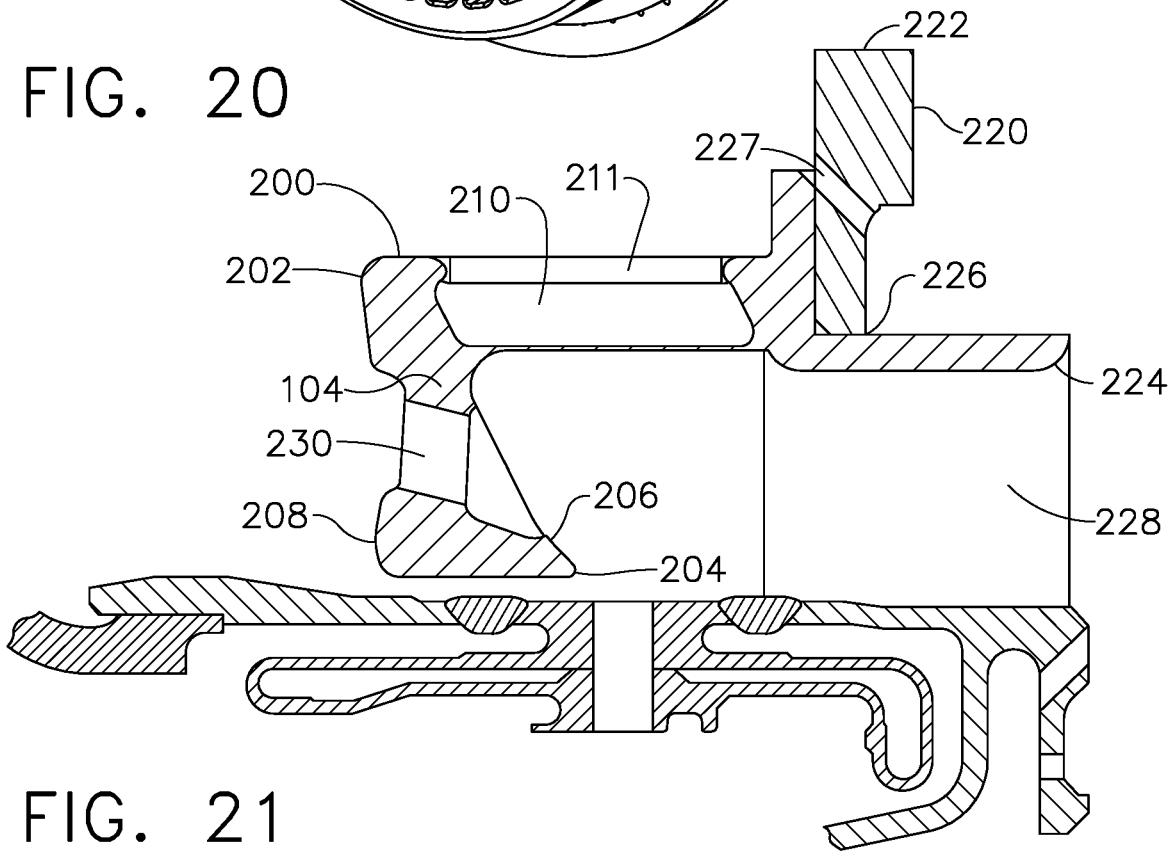
Figure 22:
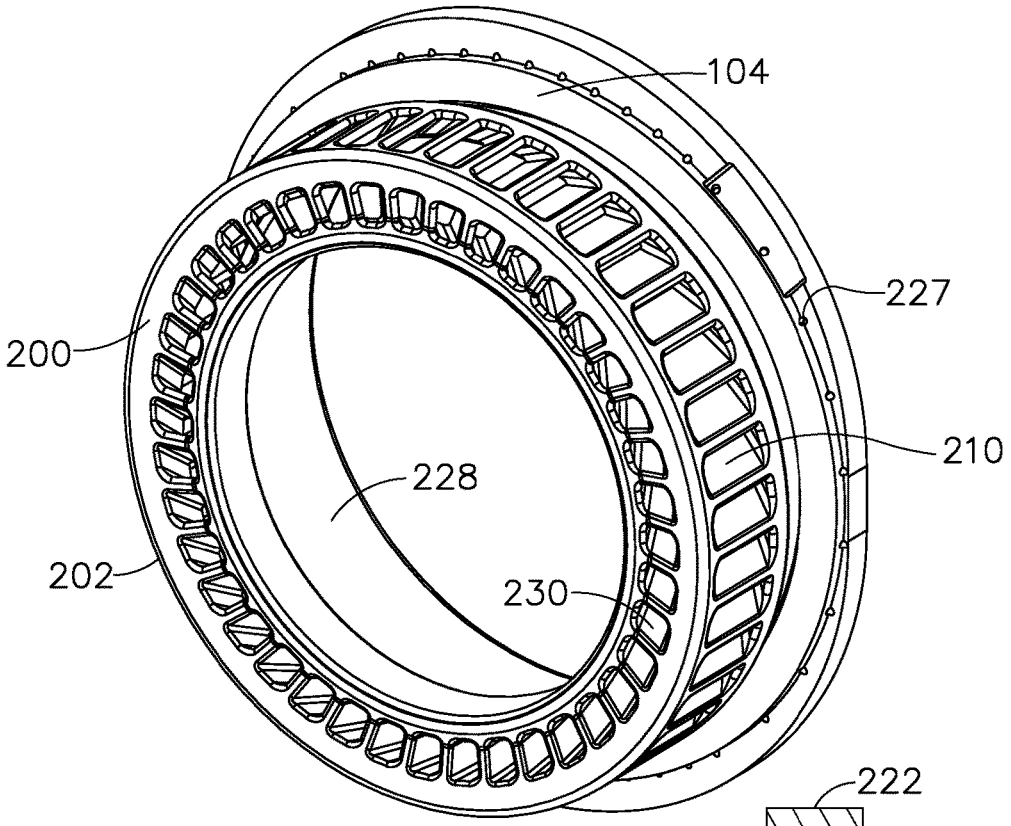
Figure 23:
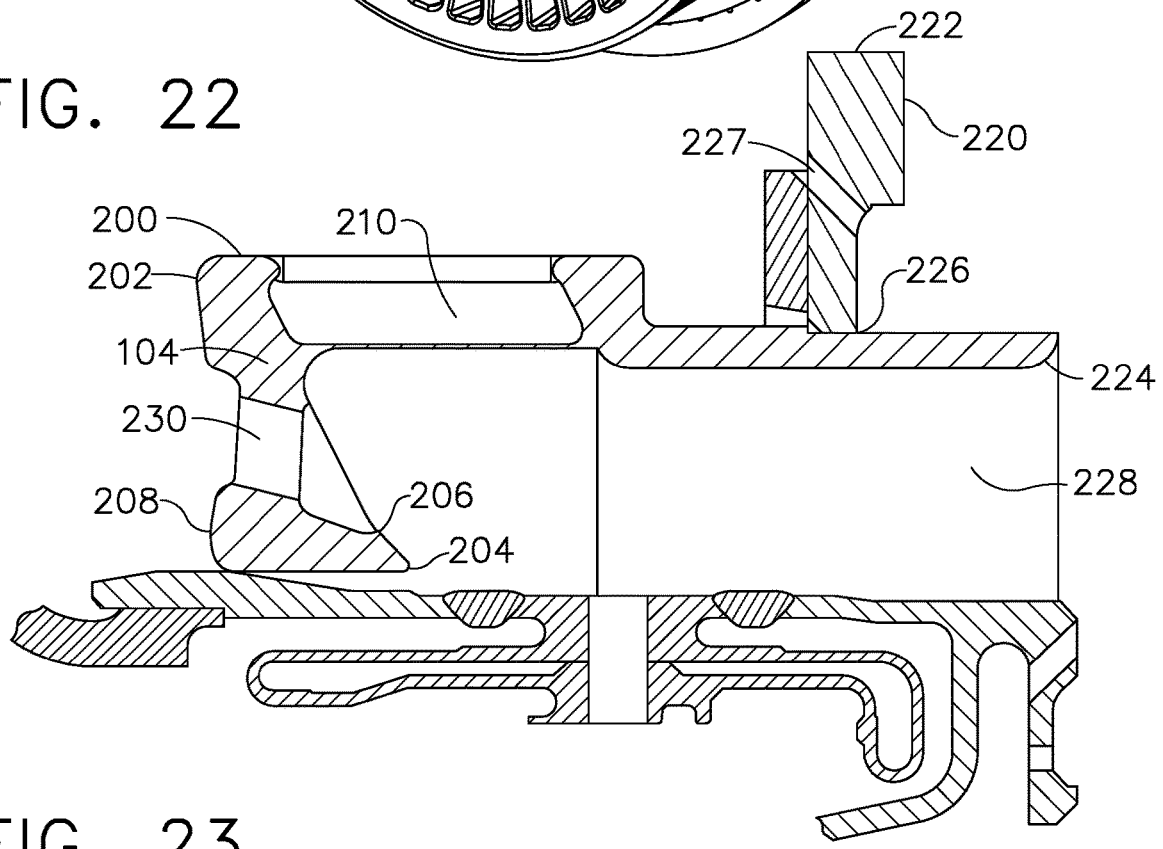
Figure 24:
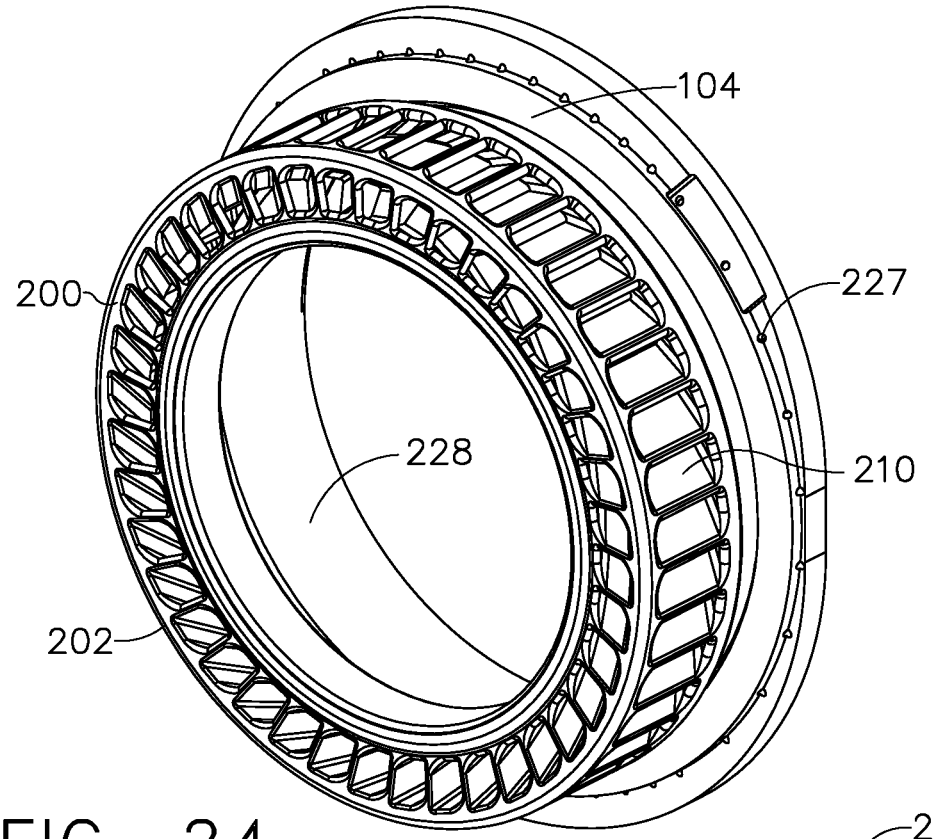
Figure 25:
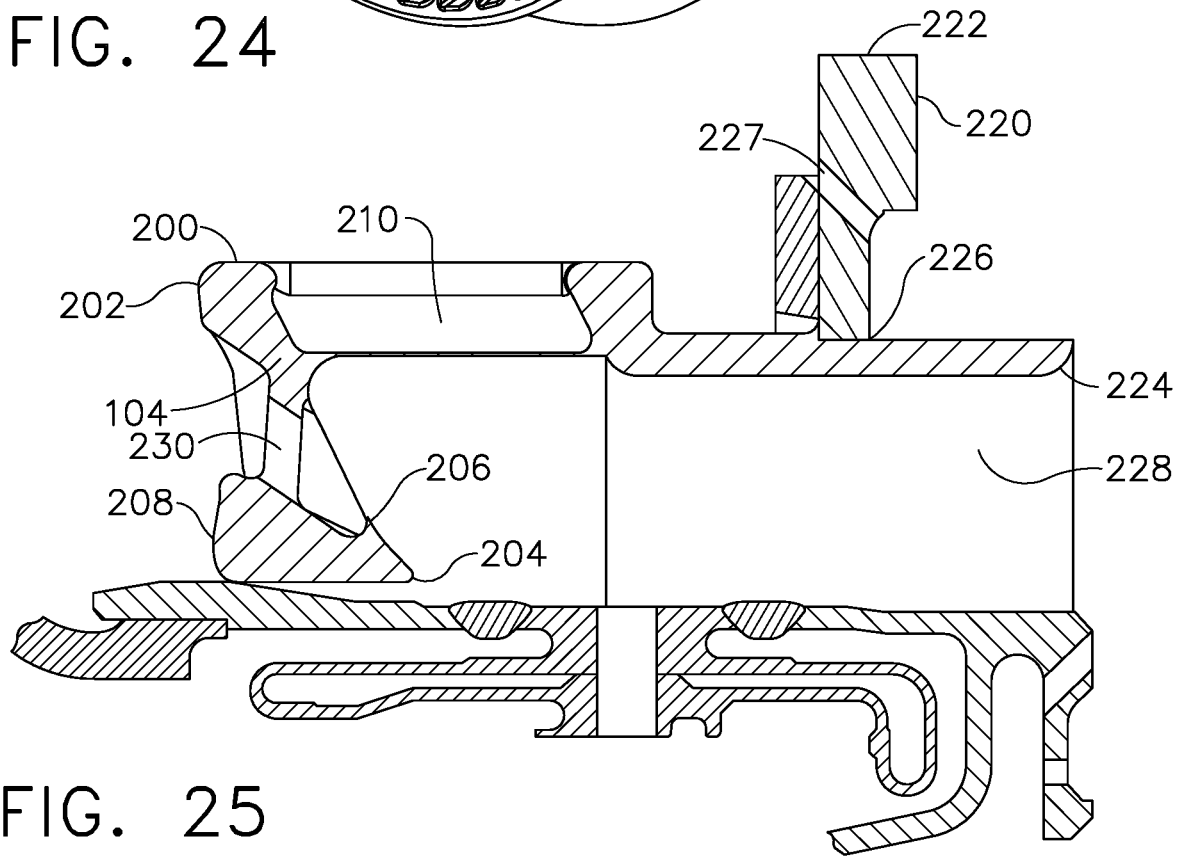

With reference to FIGS. 18 and 20, alternatives provide that the purge slots 230 of FIG. 18 may selectably grow in dimensions (see FIG. 20) to serve as one or more axial vanes. These axial vanes may also serve as an embodiment of the conical vane shown in FIGS. 26*a*, 26*b* and 27.

Alternatives (see FIGS. 26*a*, 26*b* and 27) provide that the one splitter 240 is located axially, between the first ring 200 and the second ring 220 and wherein one conical vane and one radial vane are provided; being a forward conical vane disposed between the first ring 200 and the splitter 240 and an aft radial vane disposed between the splitter 240 and the second ring 220.

Embodiments and alternatives allow for selection of length of a throat of the premixer 104 as defined by the chamber 228. By dividing chamber length 228 over vane 210 length, a ratio of those two values is determined. Embodiments provide enhanced flow and efficiency by selection the ration within a desired range of values. Alternatives include those wherein the ratio of chamber length 228 to vane 210 length is from 1:1 to 2:1. For example, and with reference to at least the embodiment illustrated in FIGS. 20-21, alternatives (for example, see FIGS. 18-19 and 22-23) include those wherein the vanes 210 are formed to be compact in relation to the chamber 228 thereby resulting in ratio values at a higher end of the range spectrum of 1:1 to 2:1. Such alternative premixers 104 show significant reductions of NOx. Embodiments include those wherein NOx reductions range from 10 to 20 percent.

Figure 17:
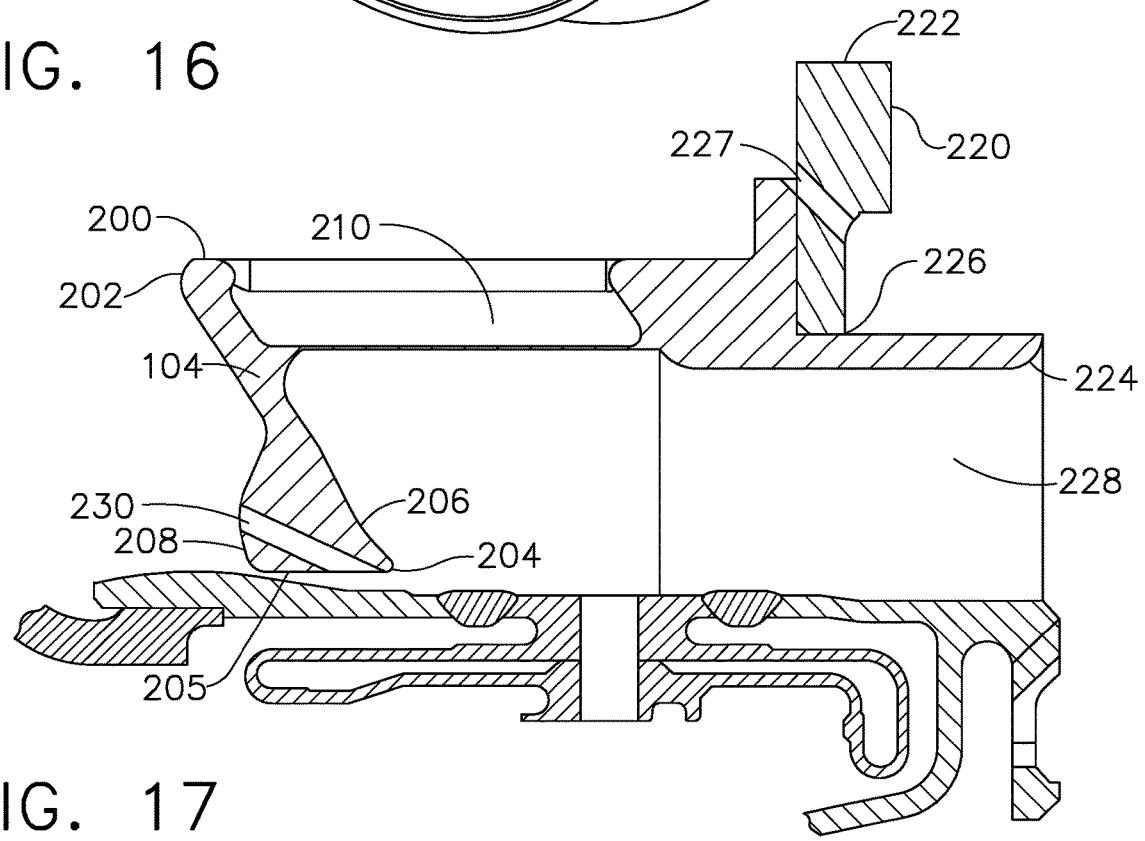

With reference to FIGS. 3, 16 and 17, embodiments include those wherein thermal growth and shrinkage is relied upon as a passive means to change relative position of the premixer 104 with respect to the fuel injector 11 thereby reducing non-uniformity of leakage gap velocity at high power. In further detail, first ring inner platform 205 moves axially, in translating motion, with respect to selected structure of the fuel injector 11 nozzle thereby opening or closing available area between fuel injector 11 and platform 205 and consequently providing passive purge air control.

Proximity reduction refers to the possibility for locating a plurality of fuel nozzles, each having a cup, within a combustor system in a desired arrangement thereby allowing a cup-to-cup distance to be optimized. Alternatives provide for the cup-to-cup distance to be 0.100 inch or greater. Tilt sensitivity refers to the possibility of repositioning the foot 208 radially downstream in respect to other designs. Embodiments and alternatives are provided that allow a 10% reduction in tilt sensitivity as seen by flow 402. As illustrated in at least FIG. 13*a*, a tilt angle 700 having a value generally in a range of between 10 to 45 degrees provides for increased velocity, increased atomization and mixing of the air and fuel in flow 402, thereby providing measurable enhancements by reducing inefficiency by a range of from 10% to 20%, along with reductions in emissions.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

We claim:

1. A system for Aerodynamically Enhanced Premixer for Reduced Emissions comprising:

a premixer being generally cylindrical in form and defined by the relationship in physical space between a first ring, a second ring, and one or more radial vanes, wherein each of the one or more radial vanes is substantially parallel to a centerline of an injector;

wherein, the first and second rings include first and second surfaces, respectively, the first and second surfaces facing each other and being generally equidistant, one from the other, at all points thereof and the radial vanes connect the first ring to the second ring and thereby form the premixer, wherein each of the one or more radial vanes has a first end and a second end;

further comprising the first ring having a first ring outer diameter and a first ring inner diameter as generally measured at a first outer point and a first inner point, respectively;

further comprising a first inner shoulder disposed inboard of the radial vanes and wherein the second ring has a second ring outer diameter and a second ring inner diameter as generally measured at a second outer point and a second inner point, respectively;

further comprising a second inner shoulder being located at a point, viewed in cross section, where the structure of the second ring moves through a generally right angle thereby forming a chamber being cylindrical;

further comprising one or more purge slots formed within the first ring, the one or more purge slots having a radial angle defined thereupon and within a range of from greater than 0 degrees to about 45 degrees with respect to a first inner platform of a foot of the first ring, such that an upstream end of the one or more purge slots lies radially outboard of a downstream end of the same one or more purge slots; and wherein the first and second surfaces contact the first and second ends, respectively of the one or more radial vanes and the first and second surfaces are disposed at a non-zero tilt angle relative to a line drawn radially outward from the centerline of the injector.

2. The system of claim 1, further comprising the one or more purge slots discharging through the first ring inner platform.

3. The system of claim 2, wherein thermal growth and shrinkage is relied upon as a passive means to change relative position of the premixer with respect to a fuel injector there by reducing non-uniformity of leakage gap velocity at high power.

4. The system of claim 3 wherein the first ring inner platform moves axially, in translating motion, with respect to selected structure of the fuel injector thereby opening or closing available area between the fuel injector and the first ring inner platform and consequently providing passive purge air control.

5. The system of claim 1, further comprising the one or more purge slots having a circumferential angle defined thereupon and within a range of from about 0 degrees to about 60 degrees.

6. A system for Aerodynamically Enhanced Premixer for Reduced Emissions comprising:

A premixer being generally cylindrical in form and defined by the relationship in physical space between a first ring, a second ring, and a plurality of radial vanes, wherein each of the plurality of radial vanes is substantially parallel to a centerline of an injector; wherein, the first and second rings include first and second surfaces, respectively, the first and second surfaces facing each other and being generally equidistant, one from the other, at all points thereof and the plurality of radial vanes connect the first ring to the second ring and thereby form the premixer, wherein each of the plurality of radial vanes has a first end and a second end;

wherein the first ring is considered to lie largely within a single plane and the second ring is offset in physical space such that the plane it occupies is generally parallel to the plane of the first ring, and the first ring has a first ring outer diameter and a first ring inner diameter as generally measured at a first outer point and a first inner point, respectively;

wherein the first ring has a first inner shoulder disposed inboard of the radial vanes; the second ring has a second ring outer diameter and a second ring inner diameter as generally measured at a second outer point and a second inner point, respectively, and a second inner shoulder is located at a point, viewed in cross section, where the structure of the second ring moves through a generally right angle such that it defines a third surface, and the third surface defines thereby forming a chamber being generally cylindrical; further comprising one or more aft lip purge flow openings being formed and disposed on the second ring, the chamber being disposed in the premixer generally apart from a region of the premixer where the radial vanes are located, the radial vanes having inlet radii being within a range of from 0.010 inches to 0.030 inches;

further comprising one or more purge slots formed within the first ring, the one or more purge slots having a radial angle defined thereupon and within a range of from greater than 0 degrees to about 45 degrees with respect to a flat surface of a foot of the first ring, such that an upstream end of the one or more purge slots lies radially outboard of a downstream end of the same one or more purge slots; and wherein the first and second surfaces contact the first and second ends, respectively of the plurality of radial vanes and the first and second surfaces are disposed at a non-zero tilt angle relative to a line drawn radially outward from the centerline of the injector.

* * * * *